US012123629B2

(12) United States Patent
Takegami et al.

(10) Patent No.: US 12,123,629 B2
(45) Date of Patent: Oct. 22, 2024

(54) HEAT SOURCE UNIT AND REFRIGERATION DEVICE HAVING LOW-STAGE AND HIGH-STAGE COMPRESSORS WITH FOUR-WAY SWITCHING VALVE

(71) Applicant: DAIKIN INDUSTRIES, LTD., Osaka (JP)

(72) Inventors: Masaaki Takegami, Osaka (JP); Naoto Kimura, Osaka (JP); Masahiko Kaneda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/371,553

(22) Filed: Sep. 22, 2023

(65) Prior Publication Data

US 2024/0011671 A1 Jan. 11, 2024

Related U.S. Application Data

(63) Continuation of application No. PCT/JP2022/010813, filed on Mar. 11, 2022.

(30) Foreign Application Priority Data

Mar. 29, 2021 (JP) ..... 2021-055213

(51) Int. Cl.
*F25B 1/10* (2006.01)
*F25B 13/00* (2006.01)
(Continued)

(52) U.S. Cl.
CPC ..... *F25B 1/10* (2013.01); *F25B 13/00* (2013.01); *F25B 41/26* (2021.01); *F25B 49/022* (2013.01);
(Continued)

(58) Field of Classification Search
CPC ..... F25B 6/04; F25B 41/26; F25B 2400/04; F25B 2400/0401; F25B 2600/25;
(Continued)

(56) References Cited

U.S. PATENT DOCUMENTS

2008/0173034 A1* 7/2008 Shaw ..... F25B 13/00 62/160
2010/0223939 A1* 9/2010 Mitra ..... F25B 1/10 62/513
(Continued)

FOREIGN PATENT DOCUMENTS

JP 2001-56157 A 2/2001
JP 2003-240391 A 8/2003
(Continued)

OTHER PUBLICATIONS

International Preliminary Report on Patentability and English translation of the Written Opinion of the International Searching Authority for International Application No. PCT/JP2022/010813, dated Oct. 12, 2023.
(Continued)

*Primary Examiner* — Jerry-Daryl Fletcher
*Assistant Examiner* — Daniel C Comings
(74) *Attorney, Agent, or Firm* — Birch, Stewart, Kolasch & Birch, LLP

(57) ABSTRACT

A heat source unit connected to a utilization-side unit and configured to perform a refrigeration cycle includes a low-stage compressor, a high-stage compressor, a four-way switching valve, a low-stage pipe, and a controller. The low-stage pipe is provided in parallel with the low-stage compressor, and the refrigerant flows therethrough while the low-stage compressor is stopped. The controller outputs an instruction signal for actuating the four-way switching valve, to the four-way switching valve while the low-stage
(Continued)

compressor is stopped and the high-stage compressor is operating.

19 Claims, 11 Drawing Sheets

(51) Int. Cl.
*F25B 41/26* (2021.01)
*F25B 49/02* (2006.01)

(52) U.S. Cl.
CPC ... *F25B 2400/075* (2013.01); *F25B 2600/025* (2013.01); *F25B 2600/0251* (2013.01); *F25B 2600/2501* (2013.01)

(58) Field of Classification Search
CPC ..... F25B 2600/0251; F25B 1/10; F25B 5/02; F25B 13/00; F25B 49/022; F25B 2400/075; F25B 2600/026; F25B 2600/0261; F25B 2600/0262; F25B 2600/027; F25B 2600/0271; F25B 2600/0272
See application file for complete search history.

(56) References Cited

U.S. PATENT DOCUMENTS

| | | | |
|---|---|---|---|
| 2022/0003463 | A1 | 1/2022 | Takegami et al. |
| 2022/0011020 | A1 | 1/2022 | Hisayama et al. |
| 2022/0146172 | A1 | 5/2022 | Taguchi et al. |

FOREIGN PATENT DOCUMENTS

| | | | | | |
|---|---|---|---|---|---|
| JP | 2007-10282 | A | | 1/2007 | |
| JP | 2015-59719 | A | | 3/2015 | |
| JP | 2020-165585 | A | | 10/2020 | |
| JP | 2021-32512 | A | | 3/2021 | |
| WO | WO-2005095868 | A1 | * | 10/2005 | ..... F24F 3/1411 |
| WO | WO 2007/083559 | A1 | | 7/2007 | |
| WO | WO 2020/203708 | A1 | | 10/2020 | |

OTHER PUBLICATIONS

International Search Report (PCT/ISA/210), issued in PCT/JP2022/010813, dated Apr. 19, 2022.
Extended European Search Report for European Application No. 22779956.6, dated Jul. 17, 2024.

* cited by examiner

HEAT SOURCE UNIT AND REFRIGERATION DEVICE HAVING LOW-STAGE AND HIGH-STAGE COMPRESSORS WITH FOUR-WAY SWITCHING VALVE

CROSS REFERENCE TO RELATED APPLICATIONS

This application is a Continuation of PCT International Application No. PCT/JP2022/010813, filed on Mar. 11, 2022, which claims priority under 35 U.S.C. 119 (a) to Patent Application No. 2021-055213, filed in Japan on Mar. 29, 2021, all of which are hereby expressly incorporated by reference into the present application.

TECHNICAL FIELD

The present disclosure relates to a heat source unit and a refrigeration apparatus.

BACKGROUND ART

Patent Document 1 discloses a refrigeration apparatus that performs a two-stage compression refrigeration cycle. FIG. 6 of Patent Document 1 shows a refrigerant circuit including a four-way switching valve and switchable between a cooling operation and a heating operation.

CITATION LIST

Patent Document

Patent Document 1: Japanese Unexamined Patent Publication No. 2001-56157

SUMMARY

A first aspect of the present disclosure is directed to a heat source unit (10) connected to a utilization-side unit (50) and configured to perform a refrigeration cycle. The heat source unit (10) includes: a low-stage compressor (23); a high-stage compressor (21) configured to suck and compress a refrigerant discharged from the low-stage compressor (23); a four-way switching valve (150) configured to switch a flow path of the refrigerant sucked into the low-stage compressor (23) and a flow path of the refrigerant discharged from the high-stage compressor (21); a low-stage pipe (24*c*) which is provided in parallel with the low-stage compressor (23) and through which the refrigerant flows while the low-stage compressor (23) is stopped; and a controller (101) configured to output an instruction signal for activating the four-way switching valve (150) while the low-stage compressor (23) is stopped and the high-stage compressor (21) is operating.

DESCRIPTION OF EMBODIMENTS

Embodiments will be described with reference to the drawings. The following embodiments are merely exemplary ones in nature, and are not intended to limit the scope, application, or uses of the invention.

«First Embodiment»

A first embodiment will be described. A refrigeration apparatus (1) according to this embodiment can cool an object to be cooled and condition indoor air. The object to be cooled herein includes air in facilities such as a refrigerator, a freezer, and a showcase.

—General Configuration of Refrigeration Apparatus—

Figure 1:
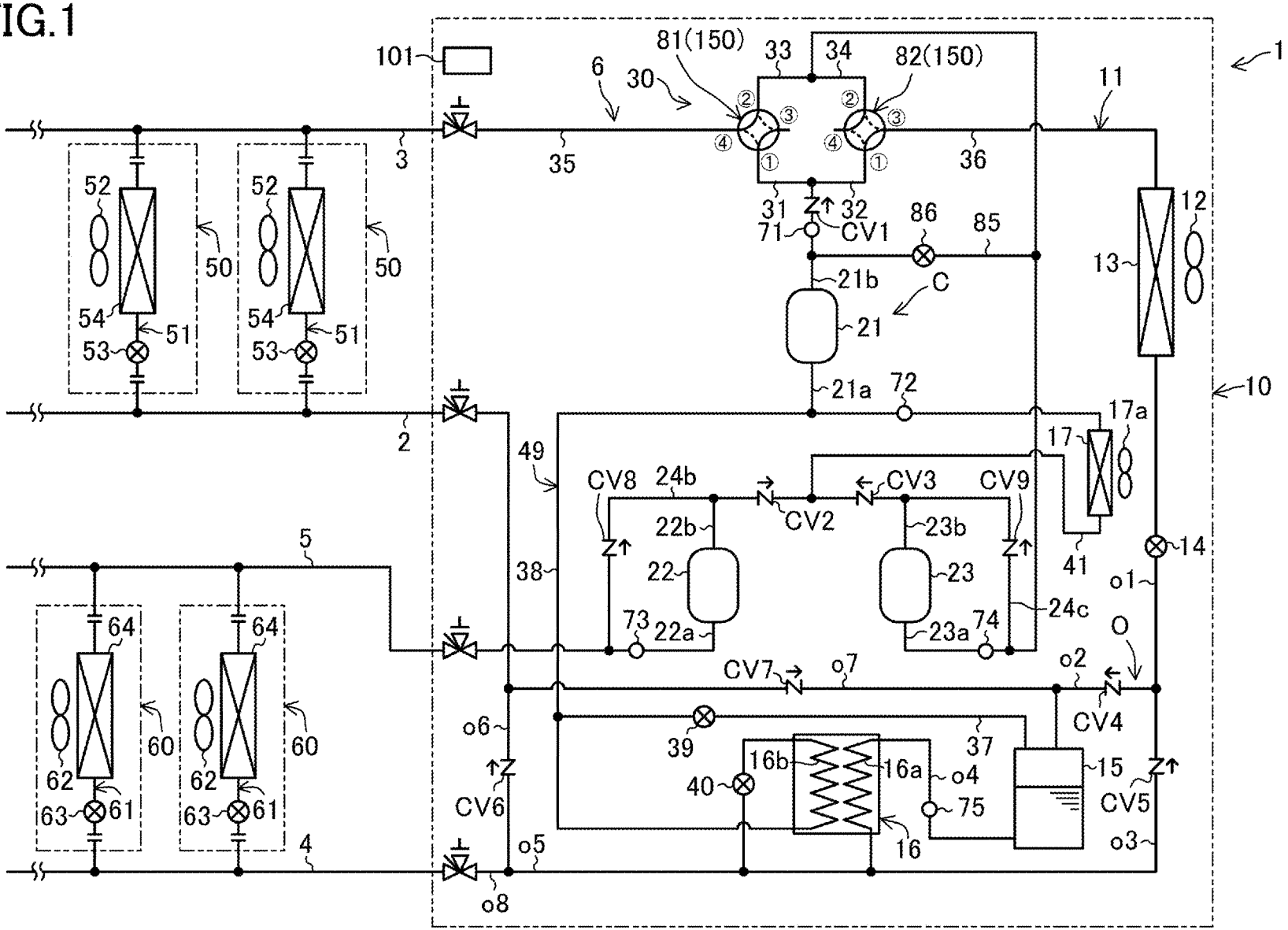
FIG. 1 is a piping system diagram showing a configuration of a refrigeration apparatus according to a first embodiment.

As illustrated in FIG. 1, the refrigeration apparatus (1) includes a heat source unit (10) placed outside, air-conditioning units (50) configured to perform air-conditioning of an indoor space, and cooling units (60) configured to cool inside air. The refrigeration apparatus (1) according to this embodiment includes one heat source unit (10), a plurality of cooling units (60), and a plurality of air-conditioning units (50). The refrigeration apparatus (1) may include one cooling unit (60) or one air-conditioning unit (50).

In the refrigeration apparatus (1), the heat source unit (10), the cooling units (60), the air-conditioning units (50) and connection pipes (2, 3, 4, 5) connecting these units (10, 50, 60) constitute a refrigerant circuit (6).

In the refrigerant circuit (6), a refrigerant circulates to perform a refrigeration cycle. The refrigerant in the refrigerant circuit (6) of this embodiment is carbon dioxide. The refrigerant circuit (6) is configured to perform the refrigeration cycle using, as a high pressure, a pressure higher than or equal to the critical pressure of the refrigerant.

In the refrigerant circuit (6), the plurality of air-conditioning units (50) are connected through a first liquid connection pipe (2) and a first gas connection pipe (3) to the heat source unit (10). In the refrigerant circuit (6), the plurality of air-conditioning units (50) are connected together in parallel.

In the refrigerant circuit (6), the plurality of cooling units (60) are connected through a second liquid connection pipe (4) and a second gas connection pipe (5) to the heat source unit (10). In the refrigerant circuit (6), the plurality of cooling units (60) are connected together in parallel.

—Heat Source Unit—

The heat source unit (10) includes an outdoor fan (12) and an outdoor circuit (11). The outdoor circuit (11) includes a compression element (C), a flow path switching mechanism (30), an outdoor heat exchanger (13), an outdoor expansion valve (14), a gas-liquid separator (15), a subcooling heat exchanger (16), an intercooler (17), and a bypass pipe (85). The heat source unit (10) includes a controller (101).

<Compression Element>

The compression element (C) compresses the refrigerant. The compression element (C) includes a high-stage compressor (21), a first low-stage compressor (23), and a second low-stage compressor (22). The high-stage compressor (21), the first low-stage compressor (23), and the second low-stage compressor (22) are each a rotary compressor in which a motor drives a compression mechanism. The high-stage compressor (21), the first low-stage compressor (23), and the second low-stage compressor (22) are of a variable capacity type capable of changing the rotational speed of the compression mechanism.

The compression element (C) performs two-stage compression. The first low-stage compressor (23) compresses the refrigerant sucked from the air-conditioning units (50) or the outdoor heat exchanger (13). The second low-stage compressor (22) compresses the refrigerant sucked from the cooling units (60). The high-stage compressor (21) sucks and compresses the refrigerant discharged from the first low-stage compressor (23) and the refrigerant discharged from the second low-stage compressor (22).

The high-stage compressor (21) is connected to a high-stage suction pipe (21*a*) and a high-stage discharge pipe (21*b*). The high-stage discharge pipe (21*b*) is a discharge pipe through which the refrigerant discharged from the high-stage compressor (21) flows. To the first low-stage compressor (23), a first low-stage suction pipe (23*a*) and a first low-stage discharge pipe (23*b*) are connected. The first low-stage suction pipe (23*a*) is a suction pipe through which the refrigerant sucked into the first low-stage compressor (23) flows. To the second low-stage compressor (22), a second low-stage suction pipe (22*a*) and a second low-stage discharge pipe (22*b*) are connected. In the compression element (C), the first low-stage discharge pipe (23*b*) and the second low-stage discharge pipe (22*b*) are connected to the high-stage suction pipe (21*a*).

The second low-stage suction pipe (22*a*) is connected to the second gas connection pipe (5). The second low-stage compressor (22) communicates with the cooling units (60) through the second gas connection pipe (5). The first low-stage suction pipe (23*a*) communicates with the air-conditioning units (50) through the flow path switching mechanism (30) and the first gas connection pipe (3).

The compression element (C) includes a first low-stage pipe (24*c*) and a second low-stage pipe (24*b*). The first low-stage pipe (24*c*) is a pipe through which the refrigerant passes while bypassing the first low-stage compressor (23). One end of the first low-stage pipe (24*c*) is connected to the first low-stage suction pipe (23*a*), and the other end is connected to the first low-stage discharge pipe (23*b*). The first low-stage pipe (24*c*) is provided in parallel with the first low-stage compressor (23). The second low-stage pipe (24*b*) is a pipe through which the refrigerant passes while bypassing the second low-stage compressor (22). One end of the second low-stage pipe (24*b*) is connected to the second low-stage suction pipe (22*a*), and the other end is connected to the second low-stage discharge pipe (22*b*). The second low-stage pipe (24*b*) is provided in parallel with the second low-stage compressor (22).

<Flow Path Switching Mechanism>

The flow path switching mechanism (30) selects one of flow paths through which the refrigerant flows in the refrigerant circuit (6). The flow path switching mechanism (30) includes a first pipe (31), a second pipe (32), a third pipe (33), a fourth pipe (34), a first switching valve (81), and a second switching valve (82).

The inflow end of the first pipe (31) and the inflow end of the second pipe (32) are connected to the high-stage discharge pipe (21*b*). The outflow end of the third pipe (33) and the outflow end of the fourth pipe (34) are connected to the first low-stage suction pipe (23*a*).

The first switching valve (81) and the second switching valve (82) each switches the flow path of the refrigerant sucked into the first low-stage compressor (23) and the flow path of the refrigerant discharged from the high-stage compressor (21). The first switching valve (81) and the second switching valve (82) are each a four-way switching valve (150). The four-way switching valves (150) used as the first switching valve (81) and the second switching valve (82) will be described in detail later.

The first port of the first switching valve (81) is connected to the outflow end of the first pipe (31). The second port of the first switching valve (81) is connected to the inflow end of the third pipe (33). The third port of the first switching valve (81) is closed. The fourth port of the first switching valve (81) is connected to one end of the first outdoor gas pipe (35). The other end of the first outdoor gas pipe (35) is connected to the first gas connection pipe (3).

The first port of the second switching valve (82) is connected to the outflow end of the second pipe (32). The second port of the second switching valve (82) is connected to the inflow end of the fourth pipe (34). The third port of the second switching valve (82) is connected to a second outdoor gas pipe (36). The fourth port of the second switching valve (82) is closed.

The first switching valve (81) and the second switching valve (82) each switches between a first state (the state indicated by the solid curves in FIG. 1) and a second state (the state indicated by the broken curves in FIG. 1). In the first state of each switching valve (81, 82), the first port and the third port communicate with each other, and the second port and the fourth port communicate with each other. In the second state of each switching valve (81, 82), the first port and the fourth port communicate with each other, and the second port and the third port communicate with each other.

<Outdoor Heat Exchanger>

The outdoor heat exchanger (13) constitutes a heat-source-side heat exchanger. The outdoor heat exchanger (13) is a fin-and-tube air heat exchanger. The outdoor fan (12) is disposed near the outdoor heat exchanger (13). The outdoor fan (12) transfers outdoor air. The outdoor heat exchanger (13) exchanges heat between the refrigerant flowing therethrough and the outdoor air transferred by the outdoor fan (12).

The gas end of the outdoor heat exchanger (13) is connected to the second outdoor gas pipe (36). The liquid end of the outdoor heat exchanger (13) is connected to an outdoor flow path (O).

<Outdoor Flow Path>

The outdoor flow path (O) includes a first outdoor pipe (o1), a second outdoor pipe (o2), a third outdoor pipe (o3), a fourth outdoor pipe (o4), a fifth outdoor pipe (o5), a sixth outdoor pipe (o6), a seventh outdoor pipe (o7), and an eighth outdoor pipe (o8).

One end of the first outdoor pipe (o1) is connected to the liquid end of the outdoor heat exchanger (13). To the other end of the first outdoor pipe (o1), one end of the second outdoor pipe (o2) and one end of the third outdoor pipe (o3) are connected. The other end of the second outdoor pipe (o2) is connected to the top of the gas-liquid separator (15).

One end of the fourth outdoor pipe (o4) is connected to the bottom of the gas-liquid separator (15). The other end of the fourth outdoor pipe (o4) is connected to one end of the fifth outdoor pipe (o5) and the other end of the third outdoor pipe (o3). The other end of the fifth outdoor pipe (o5) is connected to one end of the sixth outdoor pipe (o6) and one end of the eighth outdoor pipe (o8).

The other end of the eighth outdoor pipe (o8) is connected to the first liquid-side trunk pipe (4*a*) of the second liquid connection pipe (4). The eighth outdoor pipe (o8) is a liquid pipe through which a liquid refrigerant downstream of the gas-liquid separator (15) flows. The other end of the sixth outdoor pipe (o6) is connected to the first liquid connection pipe (2). One end of the seventh outdoor pipe (o7) is connected to an intermediate portion of the sixth outdoor pipe (o6). The other end of the seventh outdoor pipe (o7) is connected to an intermediate portion of the second outdoor pipe (o2).

<Outdoor Expansion Valve>

The first outdoor pipe (o1) of the outdoor circuit (11) is provided with an outdoor expansion valve (14). The outdoor expansion valve (14) is an electronic expansion valve having a variable opening degree.

<Gas-Liquid Separator>

The gas-liquid separator (15) constitutes a container that stores the refrigerant. The gas-liquid separator (15) is provided downstream of the outdoor expansion valve (14). In the gas-liquid separator (15), the refrigerant is separated into a gas refrigerant and a liquid refrigerant. The top of the gas-liquid separator (15) is connected to the other end of the second outdoor pipe (o2) and one end of a venting pipe (37), which will be described below.

<Intermediate Injection Circuit>

The outdoor circuit (11) includes an intermediate injection circuit (49). The intermediate injection circuit (49) is a circuit through which the refrigerant decompressed by the outdoor expansion valve (14) is supplied to the high-stage suction pipe (21*a*). The intermediate injection circuit (49) includes the venting pipe (37) and an injection pipe (38).

One end of the injection pipe (38) is connected to an intermediate portion of the fifth outdoor pipe (o5). The other end of the injection pipe (38) is connected to the high-stage suction pipe (21*a*). The injection pipe (38) is provided with a decompression valve (40). The decompression valve (40) is an expansion valve having a variable opening degree.

The venting pipe (37) is a pipe for sending the gas refrigerant in the gas-liquid separator (15) to the high-stage suction pipe (21*a*). Specifically, one end of the venting pipe (37) is connected to the top of the gas-liquid separator (15). The other end of the venting pipe (37) is connected to an intermediate portion of the injection pipe (38). The venting pipe (37) is connected to a venting valve (39). The venting valve (39) is an electronic expansion valve having a variable opening degree.

<Subcooling Heat Exchanger>

The outdoor circuit (11) includes the subcooling heat exchanger (16). The subcooling heat exchanger (16) is a heat exchanger configured to cool the refrigerant (mainly the liquid refrigerant) separated in the gas-liquid separator (15). The subcooling heat exchanger (16) is provided downstream of the gas-liquid separator (15). The subcooling heat exchanger (16) has a first flow path (16*a*) and a second flow path (16*b*). The subcooling heat exchanger (16) exchanges heat between the refrigerant flowing through the first flow path (16*a*) and the refrigerant flowing through the second flow path (16*b*).

The refrigerant flowing through the first flow path (16*a*) is cooled in the subcooling heat exchanger (16). The first flow path (16*a*) is connected to an intermediate portion of the fourth outdoor pipe (o4) serving as a liquid pipe through which the liquid refrigerant in the outdoor circuit (11) flows.

The second flow path (16*b*) is included in the intermediate injection circuit (49). Specifically, the second flow path (16*b*) is connected to a portion of the injection pipe (38) downstream of the decompression valve (40). The refrigerant that has been decompressed at the decompression valve (40) flows through the second flow path (16*b*).

<Intercooler>

The intercooler (17) is connected to an intermediate flow path (41). One end of the intermediate flow path (41) is connected to the first low-stage discharge pipe (23*b*) and the second low-stage discharge pipe (22*b*). The other end of the intermediate flow path (41) is connected to the high-stage suction pipe (21*a*).

The intercooler (17) is a fin-and-tube air heat exchanger. A fan (17*a*) is disposed near the intercooler (17). The intercooler (17) exchanges heat between the refrigerant flowing therethrough and the outdoor air transferred from the fan (17*a*).

<Check Valve>

The outdoor circuit (11) has a first check valve (CV1), a second check valve (CV2), a third check valve (CV3), a fourth check valve (CV4), a fifth check valve (CV5), a sixth check valve (CV6), a seventh check valve (CV7), an eighth check valve (CV8), and a ninth check valve (CV9). Each of these check valves (CV1 to CV9) allows the refrigerant to flow in the direction of the associated arrow shown in FIG. 1 and prohibits the refrigerant to flow in the opposite direction.

The first check valve (CV1) is connected to the high-stage discharge pipe (21*b*). The second check valve (CV2) is connected to the second low-stage discharge pipe (22*b*). The third check valve (CV3) is connected to the first low-stage discharge pipe (23*b*). The fourth check valve (CV4) is connected to the second outdoor pipe (o2). The fifth check valve (CV5) is connected to the third outdoor pipe (o3). The sixth check valve (CV6) is connected to the sixth outdoor pipe (o6). The seventh check valve (CV7) is connected to the seventh outdoor pipe (o7). The eighth check valve (CV8) is connected to the second low-stage pipe (24*b*). The ninth check valve (CV9) is connected to the first low-stage pipe (24*c*).

<Sensor>

The heat source unit (10) includes various sensors. The sensors include a high-pressure sensor (71), an intermediate-pressure sensor (72), a first low-pressure sensor (73), a second low-pressure sensor (74), and a liquid refrigerant pressure sensor (75).

The high-pressure sensor (71) detects the pressure of the refrigerant (the pressure (HP) of the high-pressure refrigerant) discharged from the high-stage compressor (21). The intermediate-pressure sensor (72) detects the pressure of the refrigerant in the intermediate flow path (41), in other words, the pressure of the refrigerant between the high-stage compressor (21) and the pair of the second low-stage compressor (22) and the first low-stage compressor (23) (the pressure (MP) of an intermediate-pressure refrigerant). The first low-pressure sensor (73) detects the pressure of the refrigerant (the pressure (LP1) of a first low-pressure refrigerant) sucked by the second low-stage compressor (22). The second low-pressure sensor (74) detects the pressure of the refrigerant (the pressure (LP2) of a second low-pressure refrigerant) sucked by the first low-stage compressor (23).

The liquid refrigerant pressure sensor (75) detects the pressure of the liquid refrigerant (the pressure (RP) of the liquid refrigerant) in the gas-liquid separator (15).

<Bypass Pipe>

One end of the bypass pipe (85) is connected to the high-stage discharge pipe (21*b*), and the other end is connected to the first low-stage suction pipe (23*a*). The bypass pipe (85) is provided with a control valve (86). The control valve (86) is a motor-operated valve having a variable opening degree.

<Controller>

Figure 2:
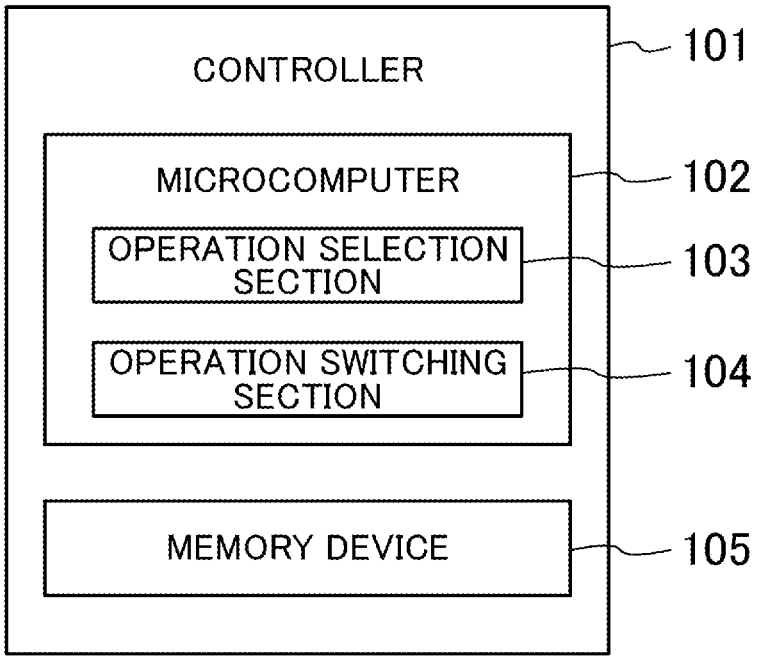
FIG. 2 is a block diagram showing a configuration of a controller of a heat source unit according to the first embodiment.

As illustrated in FIG. 2, the controller (101) includes a microcomputer (102) mounted on a control board, and a memory device (105) storing software for operating the microcomputer (102). The memory device (105) is a semiconductor memory. The controller (101) controls the components of the heat source unit (10).

The microcomputer (102) in the controller (101) functions as an operation selection section (103) and an operation switching section (104) by executing a program stored in the memory device (105). The operation selection section (103) selects an operation to be performed by the refrigeration apparatus (1) from a cooling operation, a first heating operation, a second heating operation, a third heating operation, and a defrosting operation, which will be described later. The operation switching section (104) controls the components of the refrigeration apparatus (1), to make the refrigeration apparatus (1) perform the operation selected by the operation selection section (103).

—Air-Conditioning Unit—

The air-conditioning units (50) are each a first utilization-side unit installed indoors.

The air-conditioning units (50) each condition air in an indoor space. The air-conditioning units (50) each include an indoor fan (52) and an indoor circuit (51). The liquid end of the indoor circuit (51) is connected to the first liquid connection pipe (2). The gas end of the indoor circuit (51) is connected to the first gas connection pipe (3).

The indoor circuit (51) includes an indoor expansion valve (53) and an indoor heat exchanger (54) in order from the liquid end to the gas end. The indoor expansion valve (53) is an electronic expansion valve having a variable opening degree. The indoor heat exchanger (54) is a fin-and-tube air heat exchanger. The indoor fan (52) is disposed near the indoor heat exchanger (54). The indoor fan (52) transfers indoor air. The indoor heat exchanger (54) exchanges heat between a refrigerant flowing therethrough and indoor air transferred from the indoor fan (52).

—Cooling Unit—

The cooling units (60) are each a second utilization-side unit installed indoors. The cooling units (60) are each, for example, a refrigeration showcase installed in a store, such as a convenience store. The cooling unit (60) may be a unit cooler that cools the inside air in a refrigerator.

The cooling unit (60) includes a cooling fan (62) and a cooling circuit (61). The liquid end of the cooling circuit (61) is connected to a liquid-side branch pipe (4*c*) of a second liquid connection pipe (4). The gas end of the cooling circuit (61) is connected to a gas-side branch pipe (5*c*) of a second gas connection pipe (5).

The cooling circuit (61) includes a cooling expansion valve (63) and a cooling heat exchanger (64) in order from the liquid end to the gas end. The cooling expansion valve (63) is an electronic expansion valve having a variable opening degree. The cooling heat exchanger (64) is a fin-and-tube air heat exchanger. The cooling fan (62) is disposed near the cooling heat exchanger (64). The cooling fan (62) transfers inside air. The cooling heat exchanger (64) exchanges heat between the refrigerant flowing therethrough and inside air transferred from the cooling fan (62).

—Four-Way Switching Valve—

The four-way switching valves (150) used as the first switching valve (81) and the second switching valve (82) will be described below.

<Structure of Four-Way Switching Valve>

Figure 3:
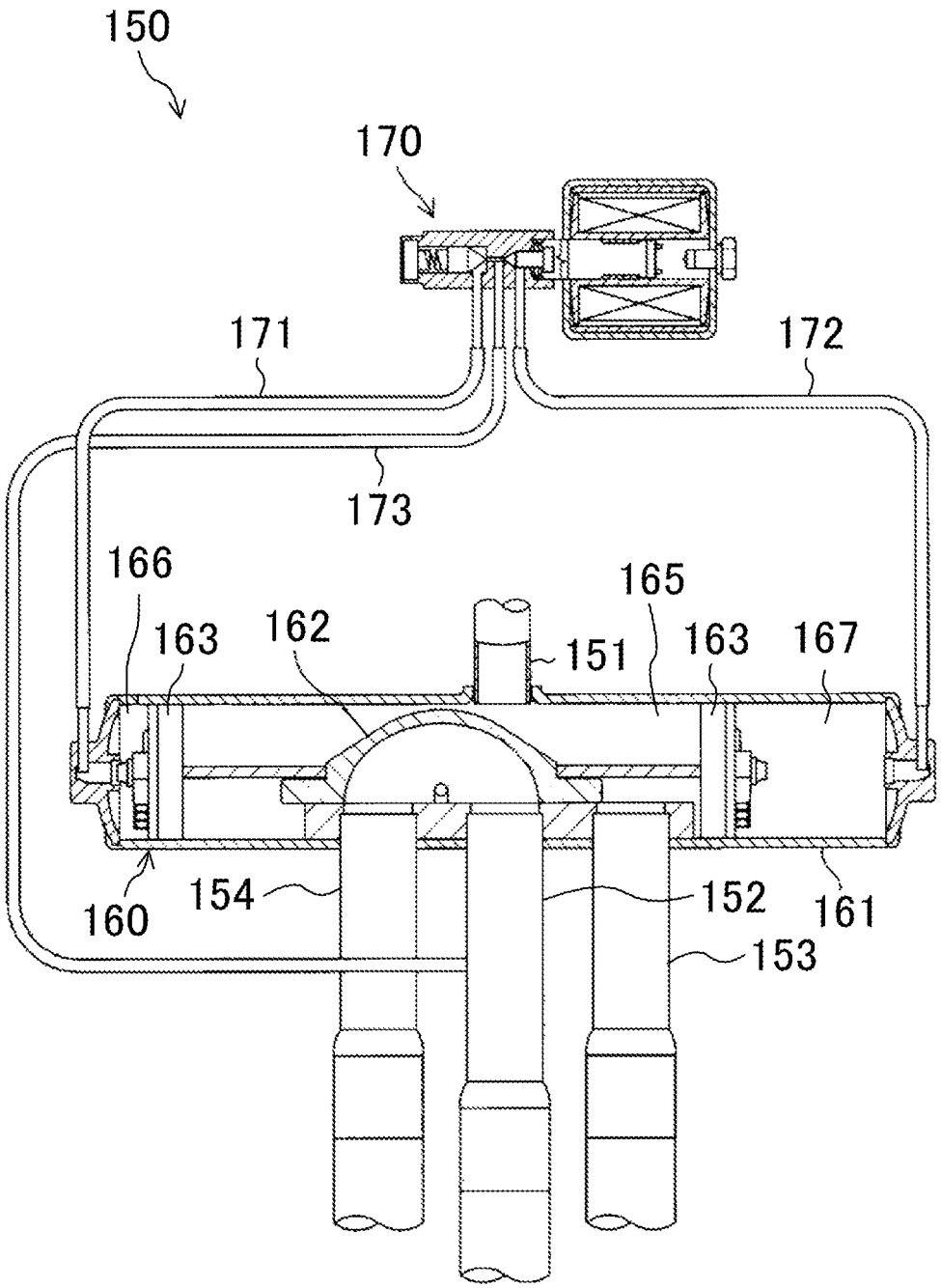
FIG. 3 is a sectional view of a configuration of a four-way switching valve.

As illustrated in FIG. 3, the four-way switching valve (150) includes a valve body (160) and a pilot valve (170). The four-way switching valve (150) is configured to be actuated by using the pressure of the refrigerant.

The valve body (160) includes one cylinder (161), one valve element (162), and two pistons (163). The cylinder (161) is a cylindrical member with both ends closed. The valve element (162) is housed in the cylinder (161) and slidable in an axial direction of the cylinder (161). The respective pistons (163) are disposed on one end and the other end of the cylinder (161). The two pistons (163) are connected to the valve element (162).

The two pistons (163) partition an internal space of the cylinder (161) into a first chamber (166), a second chamber (167), and a central chamber (165). The first chamber (166) is positioned near one end of the cylinder (161) (the left side in FIG. 3). The second chamber (167) is positioned near the other end of the cylinder (161) (the right side in FIG. 3). The central chamber (165) is a space between the two pistons (163). The valve element (162) is disposed in the central chamber (165). To the first chamber (166) and the second chamber (167), the pressure in the central chamber (165) is introduced through bleed holes provided in the pistons (163).

The cylinder (161) has a first port (151), a second port (152), a third port (153), and a fourth port (154). The first port (151) is provided in a central portion of the cylinder (161) in the axial direction. The second port (152), the third port (153), and the fourth port (154) are aligned along the longitudinal direction of the cylinder (161) so as to face the first port (151). The valve element (162) face the opening ends of the second port (152), the third port (153), and the fourth port (154).

The pilot valve (170) is an electromagnetic valve. To the pilot valve (170), a first pipe (171), a second pipe (172), and a low-pressure pipe (173) are connected. The first pipe (171) is connected to one end of the cylinder (161) and communicates with the first chamber (166). The second pipe (172) is connected to the other end of the cylinder (161) and communicates with the second chamber (167). The low-pressure pipe (173) is connected to the second port (152). The pilot valve (170) is switched between an OFF state in which the solenoid is not energized and an ON state in which the solenoid is energized. The pilot valve (170) in the OFF state makes the first pipe (171) communicate with the low-pressure pipe (173) and makes the second pipe (172) blocked from low-pressure pipe (173). The pilot valve (170) in the ON state makes the first pipe (171) blocked from the low-pressure pipe (173) and makes the second pipe (172) communicate with the low-pressure pipe (173).

<Operation of Four-Way Switching Valve>

The four-way switching valve (150) is switched between the first state and the second state by energization or non-energization of the pilot valve (170).

When the pilot valve (170) is placed in the OFF state, the four-way switching valve (150) is in the first state. In the first state, the first pipe (171) communicates with the low-pressure pipe (173), and the pressure in the first chamber (166) is lower than that in the second chamber (167). As a result, the valve element (162) is positioned closer to the first chamber (166) and makes the second port (152) communicate with the fourth port (154). In this state, the first port (151) communicates with the third port (153) via the central chamber (165).

When the pilot valve (170) is placed in the ON state, the four-way switching valve (150) is in the second state. In the second state, the second pipe (172) communicates with the low-pressure pipe (173), and the pressure in the second chamber (167) is lower than that in the first chamber (166). As a result, the valve element (162) is positioned closer to the second chamber (167) and makes the second port (152) communicate with the third port (153). In this state, the first port (151) communicates with the fourth port (154) via the central chamber (165).

—Operation of Refrigeration Apparatus—

An operation of the refrigeration apparatus (1) will be described. The refrigeration apparatus (1) performs a cooling operation, a first heating operation, a second heating operation, and a third heating operation. The refrigeration apparatus (1) also performs a defrosting operation of melting the frost attached to the outdoor heat exchanger (13).

<Cooling Operation>

Figure 4:
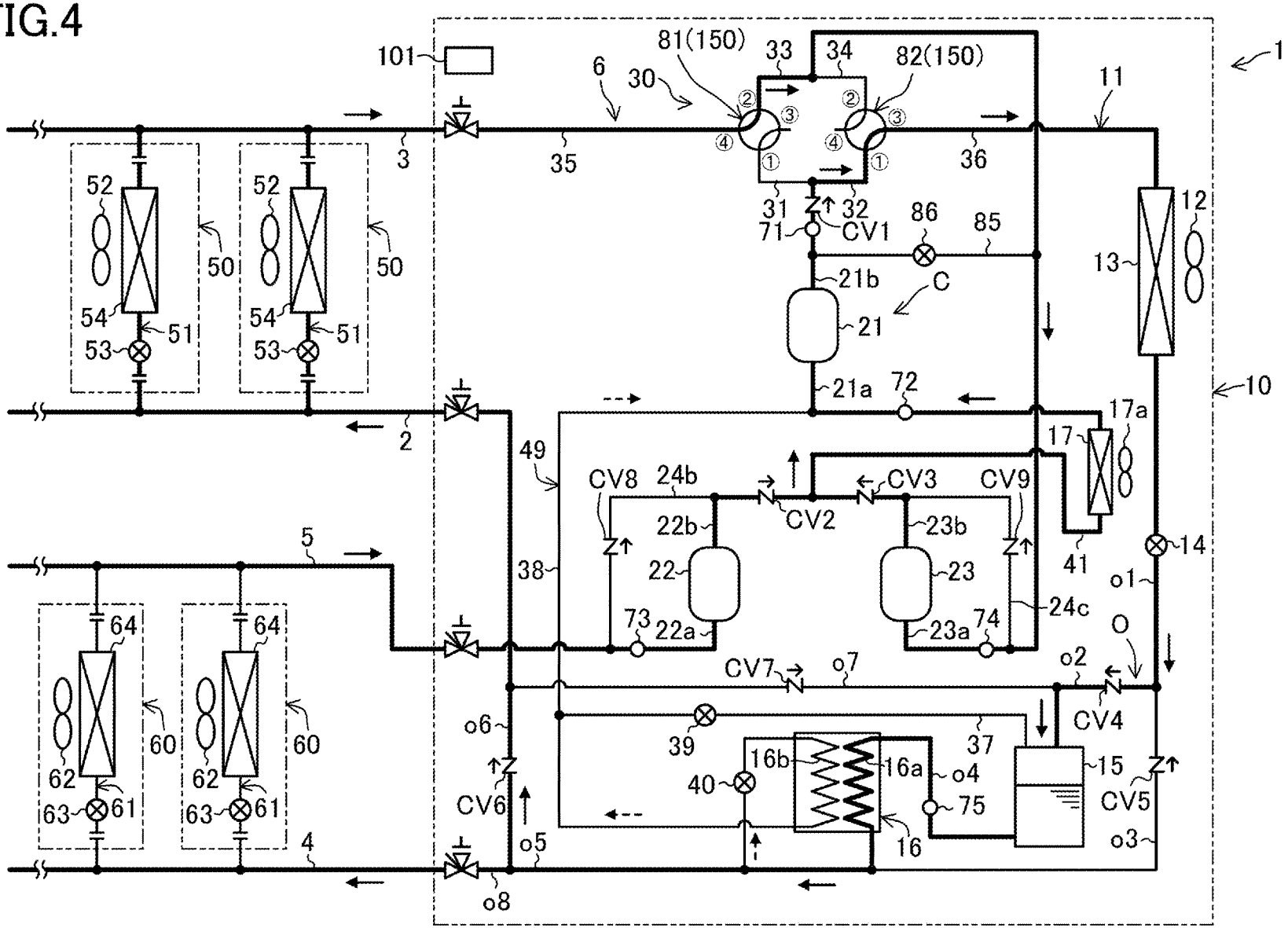
FIG. 4 corresponds to FIG. 1 and shows a flow of a refrigerant during a cooling operation.

The cooling operation of the refrigeration apparatus (1) will be described with reference to FIG. 4. The cooling operation is an operation in which the air-conditioning units (50) cool the respective indoor spaces.

In the cooling operation, the first switching valve (81) and the second switching valve (82) are set to a first state. In the cooling operation, the first low-stage compressor (23), the second low-stage compressor (22), and the high-stage compressor (21) operate. In the cooling operation, the refrigerant circuit (6) allows the refrigerant to circulate therethrough to perform a refrigeration cycle, the outdoor heat exchanger (13) functions as a radiator (a gas cooler), and the cooling heat exchangers (64) and the indoor heat exchangers (54) function as evaporators.

The refrigerant that has discharged from the high-stage compressor (21) flows through the second switching valve (82) into the outdoor heat exchanger (13) and dissipates heat to the outdoor air. The refrigerant that has passed through the outdoor heat exchanger (13) is decompressed while passing through the outdoor expansion valve (14), then passes through the gas-liquid separator (15), and is cooled while passing through the first flow path (16*a*) of the subcooling heat exchanger (16). Part of the refrigerant that has passed through the first flow path (16*a*) of the subcooling heat exchanger (16) flows through the injection pipe (38) into the second flow path (16*b*) of the subcooling heat exchanger (16), absorbs heat to evaporate, and then flows into the high-stage suction pipe (21*a*). The rest of the refrigerant that has passed through the first flow path (16*a*) of the subcooling heat exchanger (16) flows separately into the first liquid connection pipe (2) and the second liquid connection pipe (4).

The refrigerant flowing through the first liquid connection pipe (2) is distributed to each of the air-conditioning units (50). In each air-conditioning unit (50), the refrigerant that has flowed into the indoor circuit (51) is decompressed while passing through the indoor expansion valve (53), and then absorbs heat from the indoor air to evaporate in the indoor heat exchanger (54). The air-conditioning unit (50) blows the air cooled in the indoor heat exchanger (54) into the indoor space.

The refrigerant that has flowed out of the indoor heat exchanger (54) of each air-conditioning unit (50) flows and merges into the first gas connection pipe (3), then flows into the first outdoor gas pipe (35) of the outdoor circuit (11), flows through the first switching valve (81) into the first low-stage suction pipe (23*a*), and thereafter sucked into the first low-stage compressor (23) and compressed.

The refrigerant flowing through the second liquid connection pipe (4) is distributed to each cooling unit (60). In each cooling unit (60), the refrigerant that has flowed into the cooling circuit (61) is decompressed while passing through the cooling expansion valve (63), and then absorbs heat from the inside air in the cooling heat exchanger (64) and evaporates. Each cooling unit (60) blows the air cooled in the cooling heat exchanger (64) into the inside space.

The refrigerant that has flowed out of the cooling heat exchanger (64) of each cooling unit (60) flows and merges into the second gas connection pipe (5), then flows into the second low-stage suction pipe (22*a*) of the outdoor circuit (11), and is thereafter sucked into the second low-stage compressor (22) and compressed.

The refrigerant that has compressed in each of the first low-stage compressor (23) and the second low-stage compressor (22) dissipates heat to outdoor air in the intercooler (17), merges with the refrigerant flowing through the injection pipe (38), and is then sucked into the high-stage compressor (21). The high-stage compressor (21) compresses and discharges the sucked refrigerant.

<First Heating Operation>

Figure 5:
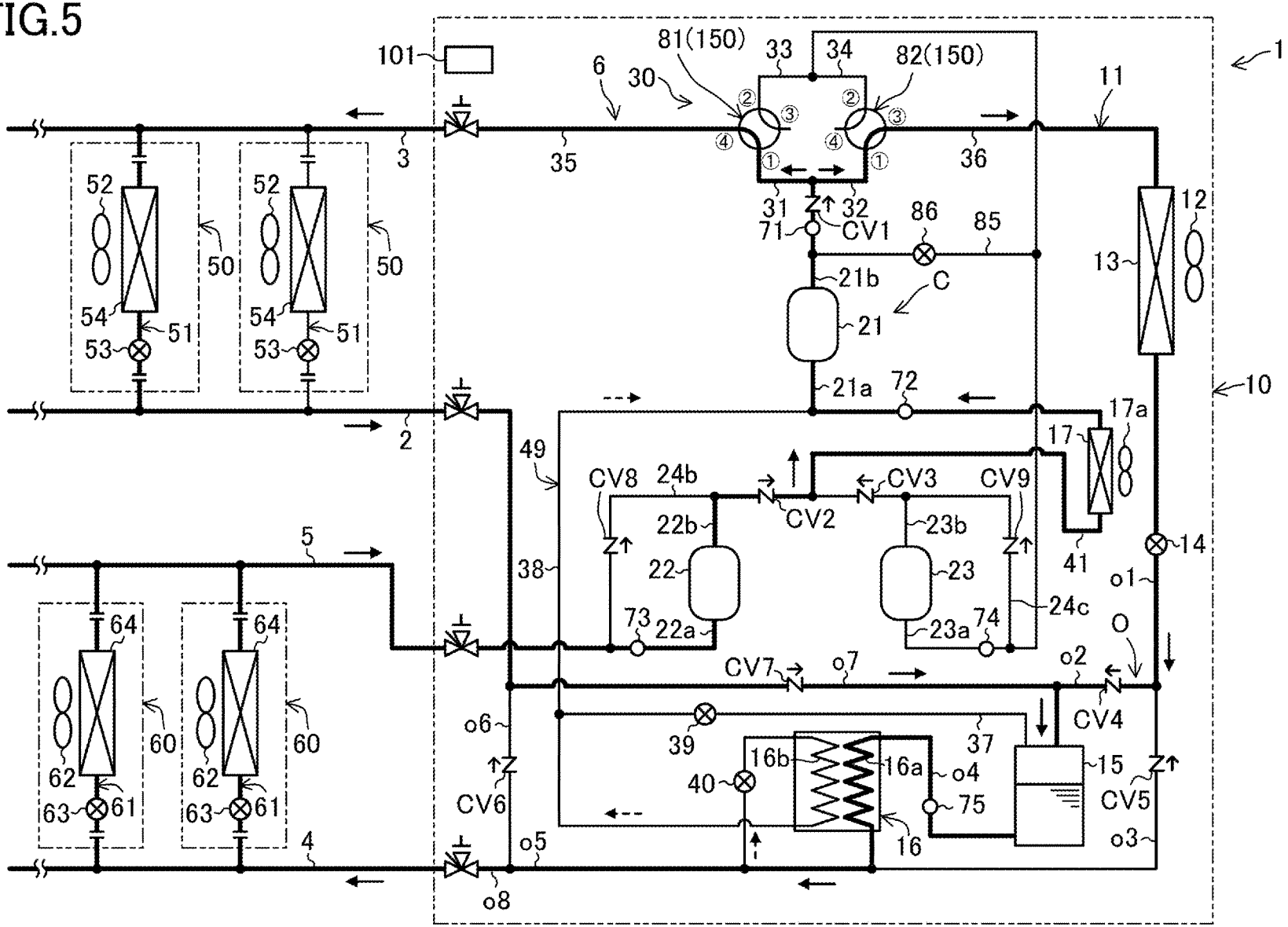
FIG. 5 corresponds to FIG. 1 and shows a flow of a refrigerant during a first heating operation.

The first heating operation of the refrigeration apparatus (1) will be described with reference to FIG. 5. The first heating operation is an operation in which the air-conditioning units (50) heat the respective indoor spaces. The first heating operation is performed in an operating state where the amount of heat dissipated from the refrigerant in the air-conditioning unit (50) is smaller than the amount of heat absorbed by the refrigerant in the cooling unit (60).

In the first heating operation, the first switching valve (81) is set to the second state, and the second switching valve (82) is set to the first state. In the first heating operation, the first low-stage compressor (23) is nonoperating, and the second low-stage compressor (22) and the high-stage compressor (21) operate. In the first heating operation, the refrigerant circuit (6) allows the refrigerant to circulate therethrough to perform a refrigeration cycle, the indoor heat exchanger (54) and the outdoor heat exchanger (13) function as radiators (gas coolers), and the cooling heat exchanger (64) functions as an evaporator.

Part of the refrigerant that has discharged from the high-stage compressor (21) flows through the first switching valve (81) into the first outdoor gas pipe (35), and the rest of the refrigerant flows through the second switching valve (82) into the second outdoor gas pipe (36).

The refrigerant flowing through the first outdoor gas pipe (35) is distributed to each air-conditioning unit (50) through the first gas connection pipe (3). In each air-conditioning unit (50), the refrigerant that has flowed into the indoor circuit (51) dissipates heat to the indoor air in the indoor heat exchanger (54), and is then decompressed while passing through the indoor expansion valve (53), and flows into the first liquid connection pipe (2). The refrigerant that has flowed from each air-conditioning unit (50) into the first liquid connection pipe (2) flows into the gas-liquid separator (15) of the outdoor circuit (11). The air-conditioning unit (50) blows the air heated in the indoor heat exchanger (54) into the indoor space.

The refrigerant flowing through the second outdoor gas pipe (36) flows into the outdoor heat exchanger (13) and dissipates heat to the outdoor air. The refrigerant that has passed through the outdoor heat exchanger (13) is decompressed while passing through the outdoor expansion valve (14) and then flows into the gas-liquid separator (15).

The refrigerant that has flowed out of the gas-liquid separator (15) is cooled while passing through the first flow path (16*a*) of the subcooling heat exchanger (16). Part of the refrigerant that has passed through the first flow path (16*a*) of the subcooling heat exchanger (16) flows through the injection pipe (38) into the second flow path (16*b*) of the subcooling heat exchanger (16), absorbs heat to evaporate, and then flows into the high-stage suction pipe (21*a*). The rest of the refrigerant that has passed through the first flow path (16*a*) of the subcooling heat exchanger (16) flows into the second liquid connection pipe (4).

The refrigerant flowing through the second liquid connection pipe (4) is distributed to each cooling unit (60). In each cooling unit (60), the refrigerant that has flowed into the cooling circuit (61) is decompressed while passing through the cooling expansion valve (63), and then absorbs heat from the inside air in the cooling heat exchanger (64) and evaporates. Each cooling unit (60) blows the air cooled in the cooling heat exchanger (64) into the inside space.

The refrigerant that has flowed out of the cooling heat exchanger (64) of each cooling unit (60) flows and merges into the second gas connection pipe (5), then flows into the second low-stage suction pipe (22*a*) of the outdoor circuit (11), and is thereafter sucked into the second low-stage compressor (22) and compressed.

The refrigerant that has compressed in the second low-stage compressor (22) dissipates heat to outdoor air in the intercooler (17), merges with the refrigerant flowing through the injection pipe (38), and is then sucked into the high-stage compressor (21). The high-stage compressor (21) compresses and discharges the sucked refrigerant.

<Second Heating Operation>

Figure 6:
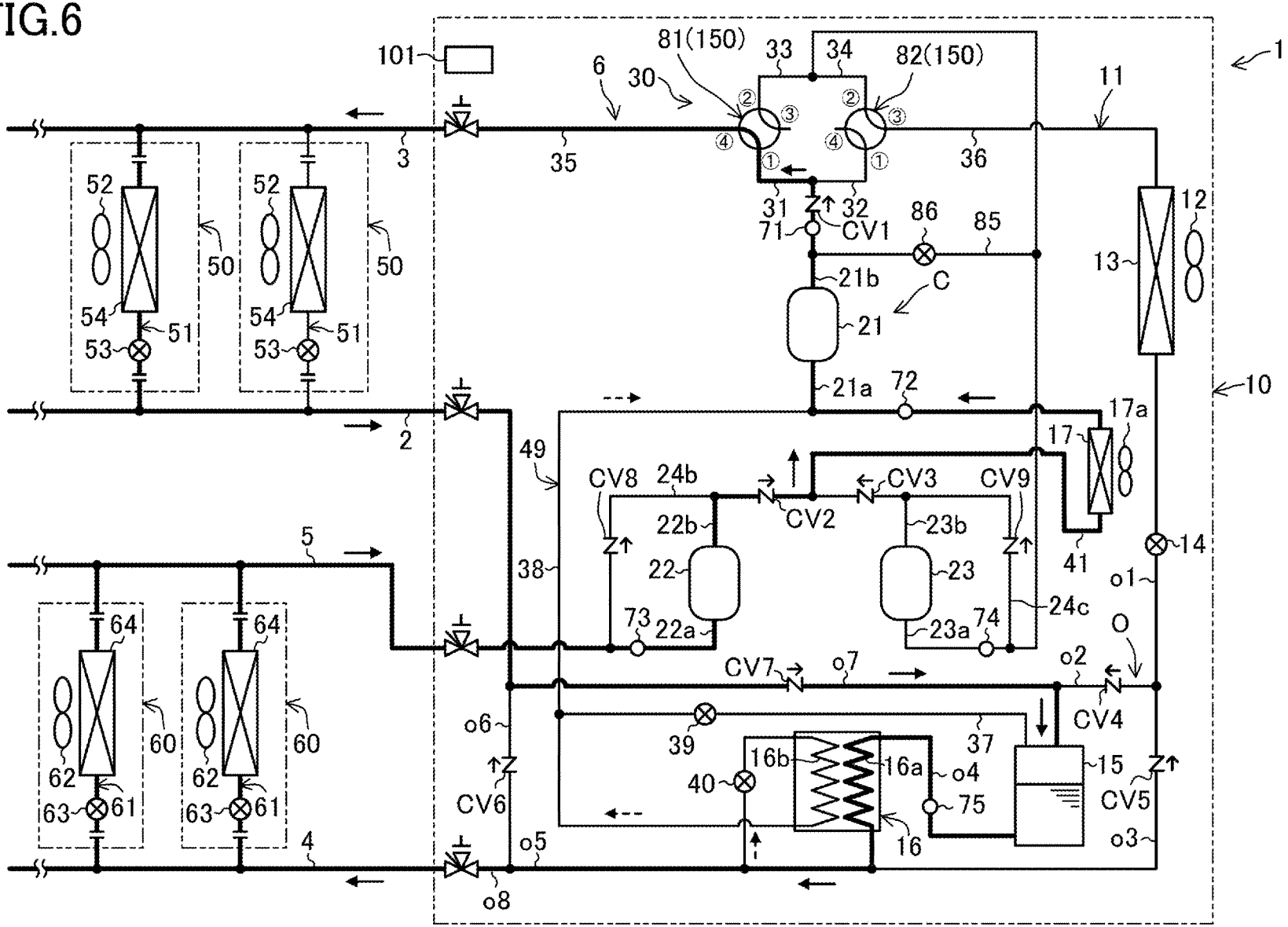
FIG. 6 corresponds to FIG. 1 and shows a flow of a refrigerant during a second heating operation.

The second heating operation of the refrigeration apparatus (1) will be described with reference to FIG. 6. The second heating operation is an operation in which the air-conditioning units (50) heat the respective indoor spaces. The second heating operation is performed in an operating state where the balance between the amount of heat dissipated from the refrigerant in the air-conditioning unit (50) and the amount of heat absorbed by the refrigerant in the cooling unit (60) is achieved.

In the second heating operation, the first switching valve (81) and the second switching valve (82) are set to the second state. In the second heating operation, the first low-stage compressor (23) is nonoperating, and the second low-stage compressor (22) and the high-stage compressor (21) operate. In the second heating operation, the refrigerant circuit (6) allows the refrigerant to circulate therethrough to perform a refrigeration cycle, the indoor heat exchanger (54) functions as a radiator (gas cooler), the cooling heat exchanger (64) functions as an evaporator, and the outdoor heat exchanger (13) is paused.

The refrigerant that has discharged from the high-stage compressor (21) flows through the first switching valve (81) into the first outdoor gas pipe (35) and is then distributed to the plurality of air-conditioning units (50) through the first gas connection pipe (3). In each air-conditioning unit (50), the refrigerant that has flowed into the indoor circuit (51) dissipates heat to the indoor air in the indoor heat exchanger (54), and is then decompressed while passing through the indoor expansion valve (53), and flows into the first liquid connection pipe (2). The refrigerant that has flowed from each air-conditioning unit (50) into the first liquid connection pipe (2) flows into the gas-liquid separator (15) of the outdoor circuit (11). The air-conditioning unit (50) blows the air heated in the indoor heat exchanger (54) into the indoor space.

The refrigerant that has flowed out of the gas-liquid separator (15) is cooled while passing through the first flow path (16*a*) of the subcooling heat exchanger (16). Part of the refrigerant that has passed through the first flow path (16*a*) of the subcooling heat exchanger (16) flows through the injection pipe (38) into the second flow path (16*b*) of the subcooling heat exchanger (16), absorbs heat to evaporate, and then flows into the high-stage suction pipe (21*a*). The rest of the refrigerant that has passed through the first flow path (16*a*) of the subcooling heat exchanger (16) flows into the second liquid connection pipe (4).

The refrigerant flowing through the second liquid connection pipe (4) is distributed to each cooling unit (60). In each cooling unit (60), the refrigerant that has flowed into the cooling circuit (61) is decompressed while passing through the cooling expansion valve (63), and then absorbs heat from the inside air in the cooling heat exchanger (64) and evaporates. Each cooling unit (60) blows the air cooled in the cooling heat exchanger (64) into the inside space.

The refrigerant that has flowed out of the cooling heat exchanger (64) of each cooling unit (60) flows and merges into the second gas connection pipe (5), then flows into the second low-stage suction pipe (22*a*) of the outdoor circuit (11), and is thereafter sucked into the second low-stage compressor (22) and compressed.

The refrigerant that has compressed in the second low-stage compressor (22) dissipates heat to outdoor air in the intercooler (17), merges with the refrigerant flowing through the injection pipe (38), and is then sucked into the high-stage compressor (21). The high-stage compressor (21) compresses and discharges the sucked refrigerant.

<Third Heating Operation>

Figure 7:
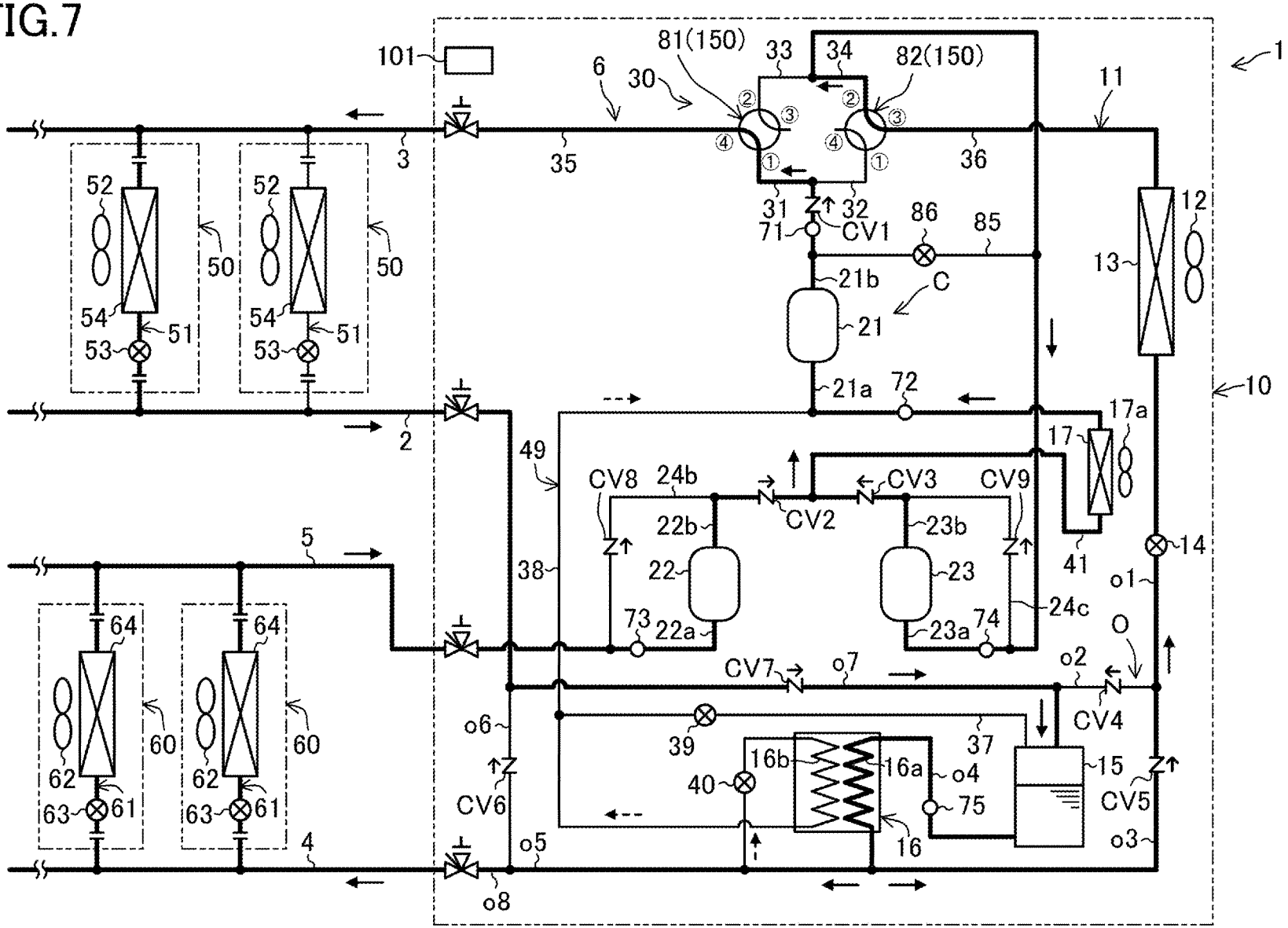
FIG. 7 corresponds to FIG. 1 and shows a flow of a refrigerant during a third heating operation.

The third heating operation of the refrigeration apparatus (1) will be described with reference to FIG. 7. The third heating operation is an operation in which the air-conditioning units (50) heat the respective indoor spaces. The third heating operation is performed in an operating state where the amount of heat dissipated from the refrigerant in the air-conditioning unit (50) is larger than the amount of heat absorbed by the refrigerant in the cooling unit (60).

In the third heating operation, the first switching valve (81) and the second switching valve (82) are set to the second state. In the third heating operation, the first low-stage compressor (23), the second low-stage compressor (22), and the high-stage compressor (21) operate. In the third heating operation, the refrigerant circuit (6) allows the refrigerant to circulate therethrough to perform a refrigeration cycle, the indoor heat exchanger (54) functions as a radiator (gas cooler), and the cooling heat exchanger (64) and the outdoor heat exchanger (13) function as evaporators.

The refrigerant that has discharged from the high-stage compressor (21) flows through the first switching valve (81) into the first outdoor gas pipe (35) and is then distributed to the plurality of air-conditioning units (50) through the first gas connection pipe (3). In each air-conditioning unit (50), the refrigerant that has flowed into the indoor circuit (51) dissipates heat to the indoor air in the indoor heat exchanger (54), and is then decompressed while passing through the indoor expansion valve (53), and flows into the first liquid connection pipe (2). The refrigerant that has flowed from each air-conditioning unit (50) into the first liquid connection pipe (2) flows into the gas-liquid separator (15) of the outdoor circuit (11). The air-conditioning unit (50) blows the air heated in the indoor heat exchanger (54) into the indoor space.

The refrigerant that has flowed out of the gas-liquid separator (15) is cooled while passing through the first flow path (16*a*) of the subcooling heat exchanger (16). The refrigerant that has passed through the first flow path (16*a*) of the subcooling heat exchanger (16) branches off and flows into the fifth outdoor pipe (o5) and the third outdoor pipe (o3).

Part of the refrigerant flowing through the fifth outdoor pipe (o5) flows into the injection pipe (38), and the rest of the refrigerant flows into the eighth outdoor pipe (o8). The refrigerant flowing through the injection pipe (38) flows into the second flow path (16*b*) of the subcooling heat exchanger (16), absorbs heat and evaporates, and then flows into the high-stage suction pipe (21*a*).

The refrigerant flowing through the eighth outdoor pipe (o8) passes through the second liquid connection pipe (4) and is distributed to the plurality of cooling units (60). In each cooling unit (60), the refrigerant that has flowed into the cooling circuit (61) is decompressed while passing through the cooling expansion valve (63), and then absorbs heat from the inside air in the cooling heat exchanger (64) and evaporates. Each cooling unit (60) blows the air cooled in the cooling heat exchanger (64) into the inside space.

The refrigerant that has flowed out of the cooling heat exchanger (64) of each cooling unit (60) flows and merges into the second gas connection pipe (5), then flows into the second low-stage suction pipe (22*a*) of the outdoor circuit (11), and is thereafter sucked into the second low-stage compressor (22) and compressed.

The refrigerant flowing through the third outdoor pipe (o3) is decompressed when passing through the outdoor expansion valve (14), then flows into the outdoor heat exchanger (13), and absorbs heat from outdoor air to evaporate. The refrigerant that has passed through the outdoor heat exchanger (13) flows through the second switching valve (82) into the first low-stage suction pipe (23*a*) and is then sucked into and compressed by the first low-stage compressor (23).

The refrigerant that has compressed in each of the first low-stage compressor (23) and the second low-stage compressor (22) dissipates heat to outdoor air in the intercooler (17), merges with the refrigerant flowing through the injection pipe (38), and is then sucked into the high-stage compressor (21). The high-stage compressor (21) compresses and discharges the sucked refrigerant.

<Defrosting Operation>

A defrosting operation of the refrigeration apparatus (1) will be described. The defrosting operation is an operation of melting the frost attached to the outdoor heat exchanger (13). When the amount of the frost attached to the outdoor heat exchanger (13) reaches a certain level or higher during the third heating operation, the refrigeration apparatus (1) temporally pauses the third heating operation and performs the defrosting operation.

In the defrosting operation, the refrigerant flows through the refrigerant circuit (6) as in the first heating operation. Specifically the second switching valve (82) is set to the first state, and the outdoor heat exchanger (13) functions as a radiator (gas cooler). The frost attached to the outdoor heat exchanger (13) is heated by the refrigerant and melts.

—Operation of Controller—

The operation performed by the operation switching section (104) of the controller (101) will be described. As mentioned above, the operation switching section (104) controls the components of the refrigeration apparatus (1), to make the refrigeration apparatus (1) perform the operation selected by the operation selection section (103).

The operation switching section (104) controls the first switching valve (81) and the second switching valve (82) to switch the operation performed by the refrigeration apparatus (1). For example, when the operation performed by the refrigeration apparatus (1) is switched from the cooling operation to the first heating operation, the operation switching section (104) performs an operation for switching the first switching valve (81) from the first state to the second state. When the operation performed by the refrigeration apparatus (1) is switched from the first heating operation to the second heating operation, the operation switching section (104) performs an operation for switching the second switching valve (82) from the first state to the second state. When the operation performed by the refrigeration apparatus (1) is switched from the third heating operation to the defrosting operation, the operation switching section (104) performs an operation for switching the second switching valve (82) from the second state to the first state.

Figure 8:
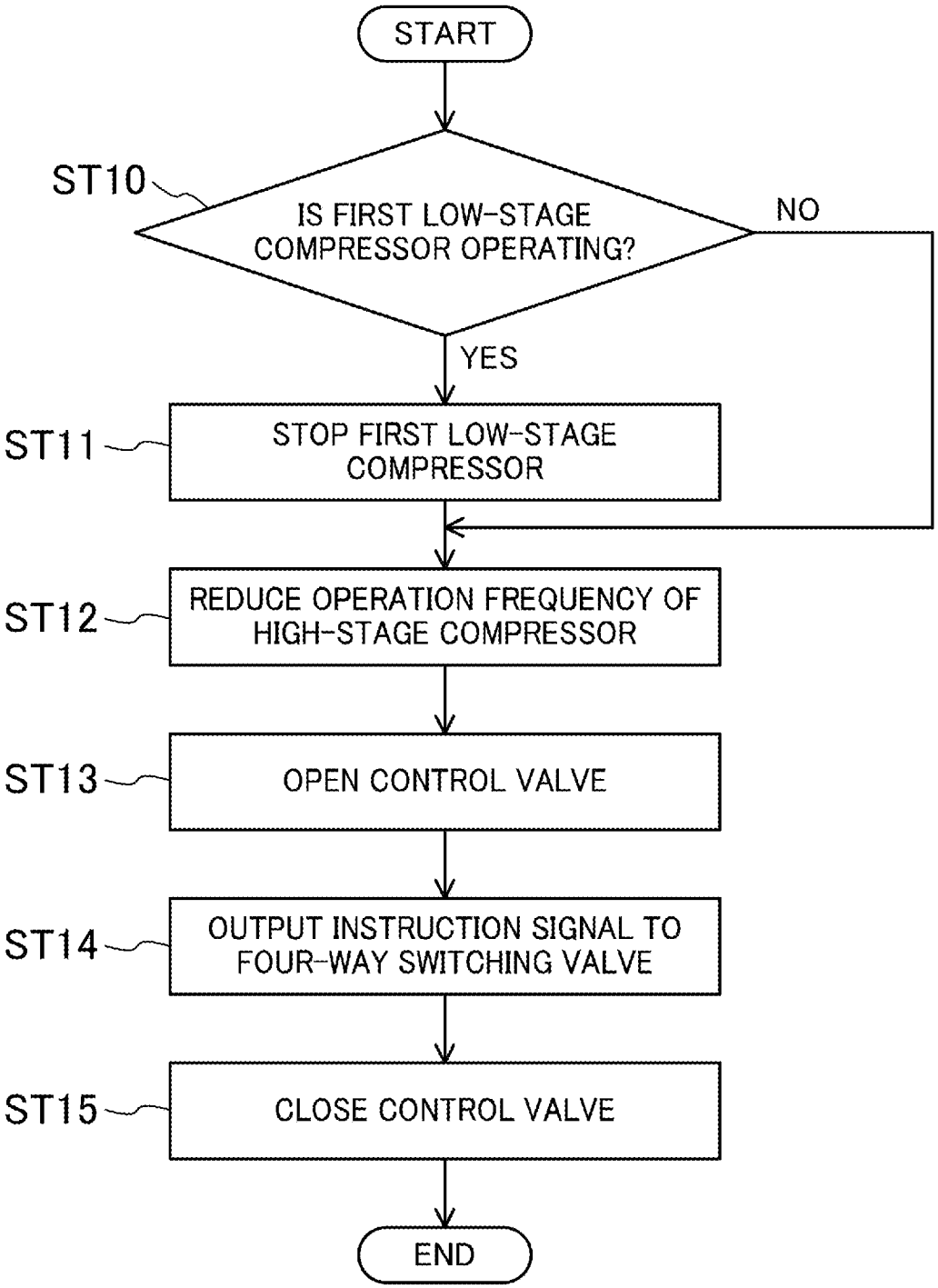
FIG. 8 is a flowchart showing an operation of an operation switching section of the controller according to the first embodiment.

When switching the four-way switching valves (150) serving as the first switching valve (81) and the second switching valve (82) from one of the first state or the second state to the other, the operation switching section (104) performs a switching operation shown in the flowchart of FIG. 8.

<Steps ST10 and ST11>

In the processing of Step ST10, the operation switching section (104) determines whether or not the first low-stage compressor (23) is operating. When the first low-stage compressor (23) is operating, the operation switching section (104) performs the processing in Step ST11 to stop the first low-stage compressor (23). After the processing of Step ST11 ends, the operation switching section (104) performs the processing of Step ST12. When the first low-stage compressor (23) is stopped, the operation switching section (104) skips the processing of Step ST11 and performs the processing of Step ST12.

<Step ST12>

In the processing of Step ST12, the operation switching section (104) decreases the operation frequency of the high-stage compressor (21). As a result, the rotational speed of the high-stage compressor (21) decreases. When the rotational speed of the high-stage compressor (21) decreases, the mass flow rate of the refrigerant discharged from the high-stage compressor (21) decreases, and the high pressure of the refrigeration cycle decreases. The high pressure of the refrigeration cycle is substantially equal to the pressure of the refrigerant flowing through the high-stage discharge pipe (21*b*). Therefore, when the rotational speed of the high-stage compressor (21) decreases, in the four-way switching valves (150) serving as the first switching valve (81) and the second switching valve (82), the difference between the pressure of the refrigerant at the first port (151) connected to the high-stage discharge pipe (21*b*) and the pressure of the refrigerant at the second port (152) connected to the first low-stage suction pipe (23*a*) decreases.

<Step ST13>

Subsequently, the operation switching section (104) performs the processing of Step ST13. In the processing of Step ST13, the operation switching section (104) gradually opens the control valve (86) in the fully closed state, to a predetermined opening degree.

When the control valve (86) opens, part of the refrigerant flowing through the high-stage discharge pipe (21*b*) flows through the bypass pipe (85) into the first low-stage suction pipe (23*a*), thereby increasing the pressure of the refrigerant in the first low-stage suction pipe (23*a*). As a result, in the four-way switching valves (150) serving as the first switching valve (81) and the second switching valve (82), the difference between the pressure of the refrigerant at the first port (151) connected to the high-stage discharge pipe (21*b*) and the pressure of the refrigerant at the second port (152) connected to the first low-stage suction pipe (23*a*) decreases.

<Step ST14>

Then, the operation switching section (104) performs the processing of Step ST14. In the processing of Step ST14, the operation switching section (104) outputs an instruction signal for activating the four-way switching valve (150) serving as one of the first switching valve (81) or the second switching valve (82) which needs to be switched, to the four-way switching valve (150). Specifically, the operation switching section (104) outputs, as the instruction signal, a signal for switching energization of the pilot valve (170) of the four-way switching valve (150) to which the instruction signal is output, from one of the ON state or the OFF state to the other. As a result, the four-way switching valve (150) that has received the instruction signal is switched from one of the first state or the second state to the other.

While the first low-stage compressor (23) is stopped and the high-stage compressor (21) is operating, the operation switching section (104) outputs the instruction signal to the four-way switching valves (150) serving as the first switching valve (81) and the second switching valve (82). Further, the operation switching section (104) reduces the rotational speed of the high-stage compressor (21), further opens the control valve (86), and then outputs the instruction signal to the four-way switching valve (150).

In this way, the operation switching section (104) reduces the difference between the pressure of the refrigerant at the first port (151) and the pressure of the refrigerant at the second port (152), and then outputs the instruction signal to the four-way switching valve (150). Therefore, the load acting on the valve element (162) and the pistons (163) when the four-way switching valve (150) is switched is reduced, and the impact force caused by the movement of the valve element (162) and the pistons (163) is reduced. As a result, it is possible to prevent the damage to the four-way switching valve (150) and the damage to the pipes connected to the four-way switching valve (150) from occurring, thereby improving reliability of the heat source unit (10).

<Step ST15>

Then, the operation switching section (104) performs the processing of Step ST15. In the processing of Step ST15, the operation switching section (104) fully closes the control valve (86). After the processing of Step ST15 ends, the operation switching section (104) ends the switching operation.

—Features of First Embodiment—

In the heat source unit (10) of this embodiment, while the first low-stage compressor (23) is stopped and the high-stage compressor (21) is operating, the operation switching section (104) of the controller (101) reduces the rotational speed of the high-stage compressor (21), opens the control valve (86), and then outputs the instruction signal to the four-way switching valves (150) serving as the first switching valve (81) and the second switching valve (82).

In this way, the operation switching section (104) of the controller (101) according to this embodiment reduces the difference between the pressure of the refrigerant at the first port (151) and the pressure of the refrigerant at the second port (152) in the four-way switching valve (150), and then outputs the instruction signal to the four-way switching valve (150). Therefore, the load acting on the valve element (162) and the pistons (163) when the four-way switching valve (150) is switched is reduced, and as a result, the impact force caused by the movement of the valve element (162) and the pistons (163) is reduced. Accordingly, this embodiment makes it possible to prevent damage to the four-way switching valve (150) and the damage to the pipes connected to the four-way switching valve (150) from occurring, thereby improving reliability of the heat source unit (10).

—Variations of First Embodiment—

Figure 9:
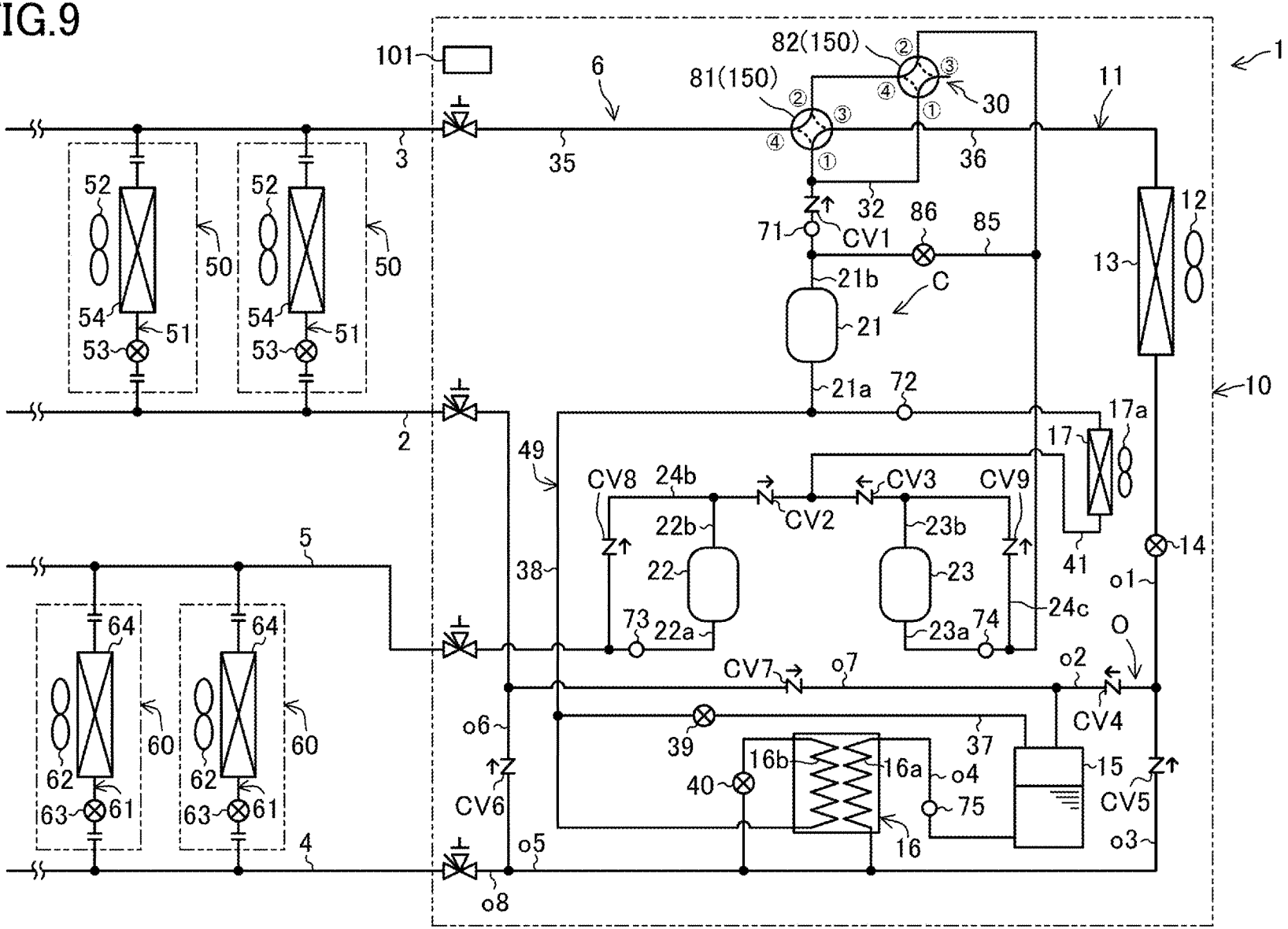
FIG. 9 is a piping system diagram showing a configuration of a refrigeration apparatus according to a variation of the first embodiment.

In the heat source unit (10) according to this embodiment, the flow path switching mechanism (30) may be configured as illustrated in FIG. 9.

The flow path switching mechanism (30) according to this variation includes a first switching valve (81) and a second switching valve (82) which are each a four-way switching valve (150) as in the flow path switching mechanism (30) illustrated in FIG. 1.

The first port of the first switching valve (81) is connected to a high-stage discharge pipe (21*b*). The second port of the first switching valve (81) is connected to the fourth port of the second switching valve (82) via a pipe. The third port of the first switching valve (81) is connected to the second outdoor gas pipe (36). The fourth port of the first switching valve (81) is connected to the first outdoor gas pipe (35).

The first port of the second switching valve (82) is connected to a downstream side of the first check valve (CV1) in the high-stage discharge pipe (21*b*) via a pipe. The second port of the second switching valve (82) is connected to the first low-stage suction pipe (23*a*). The third port of the second switching valve (82) is closed. The fourth port of the second switching valve (82) is connected to the second port of the first switching valve (81) via a pipe.

As in the flow path switching mechanism (30) illustrated in FIG. 1, the first switching valve (81) and the second switching valve (82) each switches between a first state (the state indicated by the solid curves in FIG. 9) and a second state (the state indicated by the broken curves in FIG. 9).

In the cooling operation, the first switching valve (81) and the second switching valve (82) are set to a first state. In the first heating operation, the first switching valve (81) and the second switching valve (82) are set to the second state. In the second heating operation, the first switching valve (81) is set to the second state, and the second switching valve (82) is set to the first state. In the third heating operation, the first switching valve (81) is set to the second state, and the second switching valve (82) is set to the first state.

«Second Embodiment»

A second embodiment will be described. Here, with respect to the refrigeration apparatus (1) according to this embodiment, differences from the refrigeration apparatus (1) according to the first embodiment will be described.

—Configuration of Refrigeration Apparatus—

Figure 10:
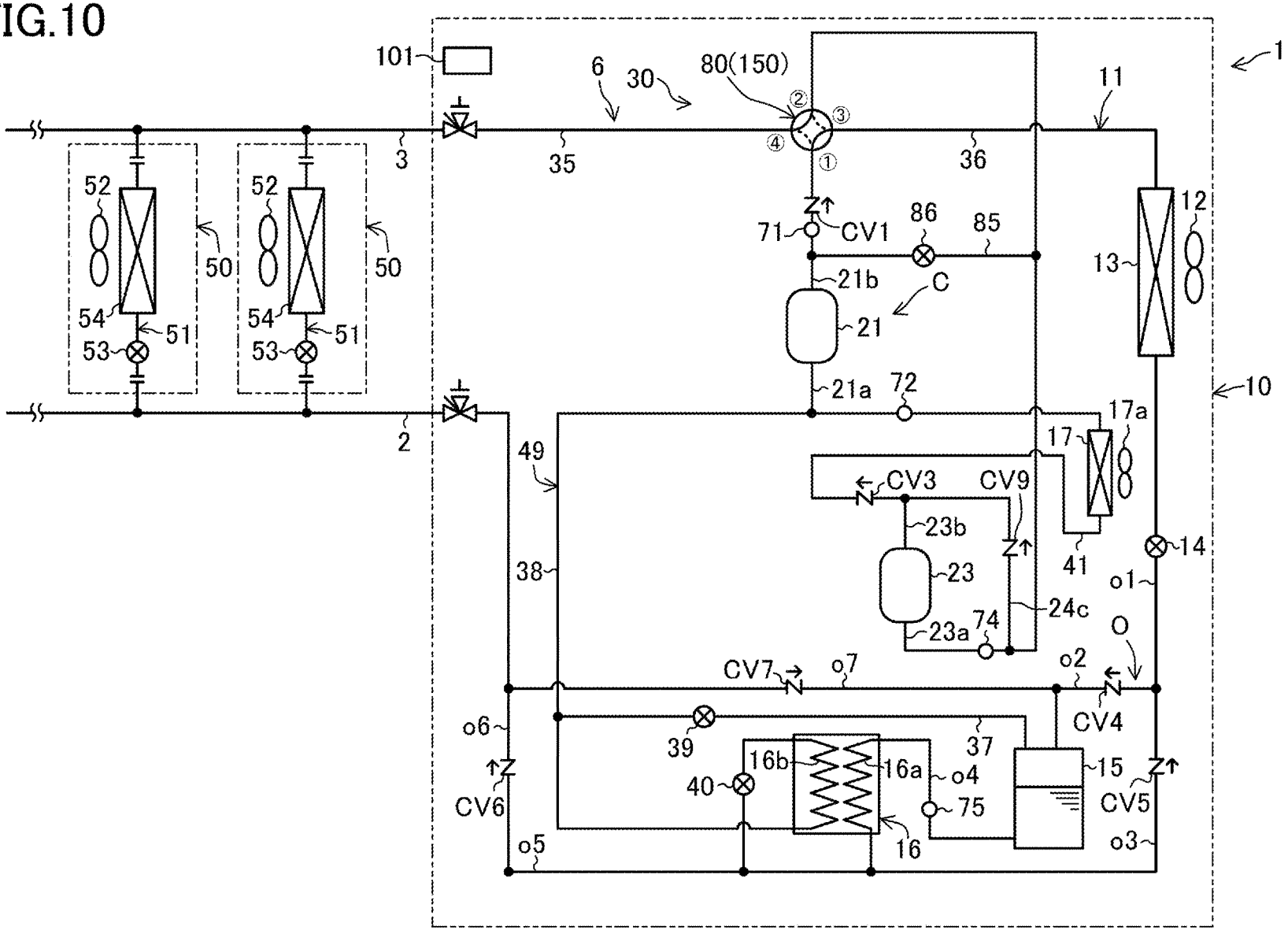
FIG. 10 is a piping system diagram showing a configuration of a refrigeration apparatus according to a second embodiment.

As illustrated in FIG. 10, the refrigeration apparatus (1) according to this embodiment excludes the cooling units (60) according to the first embodiment. In the refrigerant circuit (6) of the refrigeration apparatus (1) according to this embodiment, one heat source unit (10) and a plurality of air-conditioning units (50) are connected to each other by the first liquid connection pipe (2) and the second gas connection pipe (5).

The heat source unit (10) according to this embodiment excludes the second low-stage compressor (22), the second low-stage suction pipe (22*a*), and the second low-stage discharge pipe (22*b*) according to the first embodiment. The compression element (C) according to this embodiment includes the first low-stage compressor (23) and the high-stage compressor (21), but no second low-stage compressor (22).

The heat source unit (10) according to this embodiment includes a switching valve (80) in place of the flow path switching mechanism (30) according to the first embodiment. Like the first switching valve (81) and the second switching valve (82) according to the first embodiment, the switching valve (80) is a four-way switching valve (150). The switching valve (80) has a first port connected to the high-stage discharge pipe (21*b*), a second port connected to the first low-stage suction pipe (23*a*), a third port connected to the second outdoor gas pipe (36), and a fourth port connected to the first outdoor gas pipe (35).

The switching valve (80) switches between a first state (the state indicated by the solid curves in FIG. 10) and a second state (the state indicated by the broken curves in FIG. 10). In the switching valve (80) in the first state, the first port and the third port communicate with each other, and the second port and the fourth port communicate with each other. In the switching valve (80) in the second state, the first port and the fourth port communicate with each other, and the second port and the third port communicate with each other.

—Operation of Refrigeration Apparatus—

The refrigeration apparatus (1) according to this embodiment performs a cooling operation, a heating operation, and a defrosting operation.

In the cooling operation, the switching valve (80) is set to the first state. In the refrigerant circuit (6) performing the cooling operation, the first low-stage compressor (23) and the high-stage compressor (21) operate, the outdoor heat exchanger (13) functions as a radiator (gas cooler), and the indoor heat exchanger (54) of each air-conditioning unit (50) functions as an evaporator.

In the heating operation, the switching valve (80) is set to the second state. In the refrigerant circuit (6) performing the heating operation, the first low-stage compressor (23) and the high-stage compressor (21) operate, the indoor heat exchanger (54) of each air-conditioning unit (50) functions as a radiator (gas cooler), and the outdoor heat exchanger (13) functions as an evaporator.

The defrosting operation is an operation of melting the frost attached to the outdoor heat exchanger (13). When the amount of the frost attached to the outdoor heat exchanger (13) reaches a certain level or higher during the heating operation, the refrigeration apparatus (1) temporally pauses the heating operation and performs the defrosting operation.

In the defrosting operation, the refrigerant flows through the refrigerant circuit (6) as in the cooling operation. Specifically the switching valve (80) is set to the first state, and the outdoor heat exchanger (13) functions as a radiator (gas cooler). The frost attached to the outdoor heat exchanger (13) is heated by the refrigerant and melts.

—Operation of Controller—

The operation performed by the operation switching section (104) of the controller (101) will be described. The operation switching section (104) according to this embodiment controls the components of the refrigeration apparatus (1), to make the refrigeration apparatus (1) perform the operation selected by the operation selection section (103) in the same manner as in the first embodiment.

The operation switching section (104) controls the switching valve (80) to change the operation performed by the refrigeration apparatus (1). For example, when the operation performed by the refrigeration apparatus (1) is switched from the cooling operation to the heating operation, the operation switching section (104) performs an operation for switching the first switching valve (80) from the first state to the second state. When the operation performed by the refrigeration apparatus (1) is switched from the heating operation to the cooling operation or the defrosting operation, the operation switching section (104) performs an operation for switching the switching valve (80) from the second state to the first state.

Figure 11:
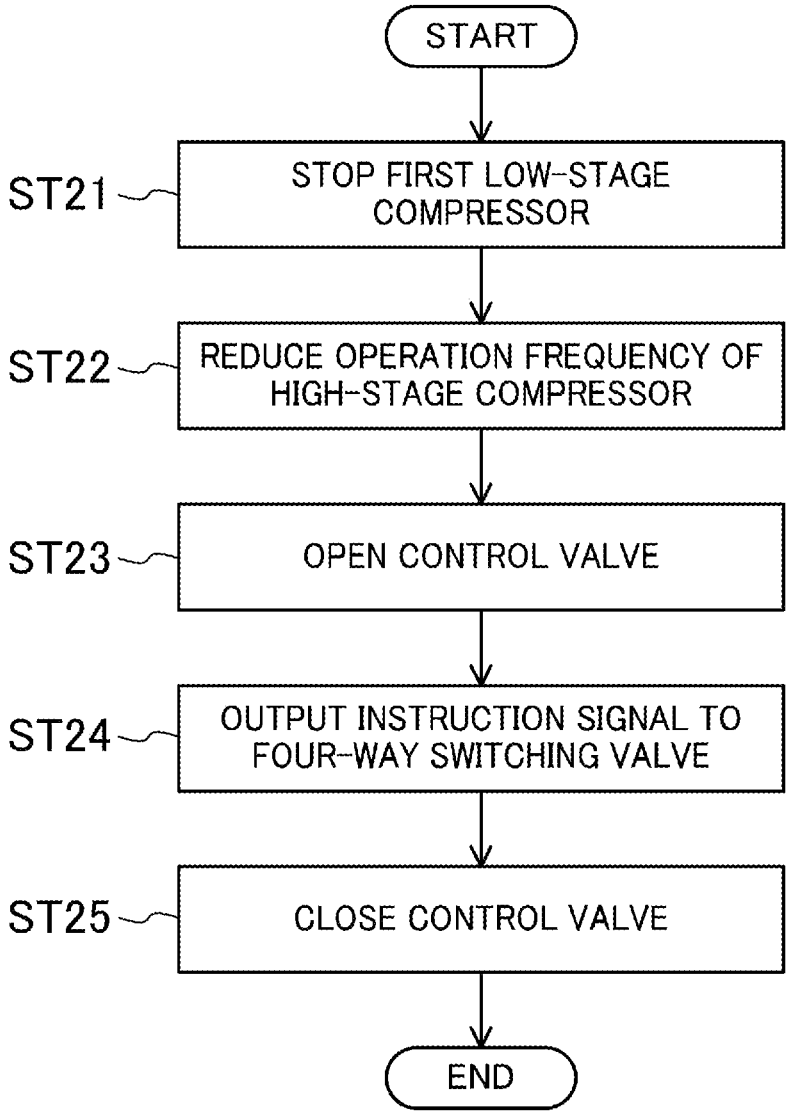
FIG. 11 is a flowchart showing an operation of an operation switching section of a controller according to the second embodiment.

When switching the four-way switching valve (150) serving as the switching valve (80) from the first state to the second state, the operation switching section (104) performs a switching operation shown in the flowchart of FIG. 11.

In the refrigeration apparatus (1) according to this embodiment, the first low-stage compressor (23) and the high-stage compressor (21) both operate in all the cooling operation, the heating operation, and the defrosting operation. Thus, the processing of Step ST10 in FIG. 8 performed by the operation switching section (104) according to the first embodiment is omitted from the processing performed by the operation switching section (104) according to this embodiment.

<Step ST21>

In the processing of Step ST21, the operation switching section (104) stops the first low-stage compressor (23). When the first low-stage compressor (23) is stopped, the refrigerant flowing through the first low-stage suction pipe (23*a*) flows into the first low-stage discharge pipe (23*b*) through the first low-stage pipe (24*c*), and then flows into the high-stage compressor (21) through the high-stage suction pipe (21*a*).

When only the high-stage compressor (21) sucks and compresses the refrigerant, the low pressure of the refrigeration cycle increases, and the high pressure of the refrigeration cycle decreases. The low pressure of the refrigeration cycle is substantially equal to the pressure of the refrigerant flowing through the first low-stage suction pipe (23*a*). The high pressure of the refrigeration cycle is substantially equal to the pressure of the refrigerant flowing through the high-stage discharge pipe (21*b*). Therefore, when the first low-stage compressor (23) is stopped, in the four-way switching valves (150) serving as the switching valve (80), the difference between the pressure of the refrigerant at the first port (151) connected to the high-stage discharge pipe (21*b*) and the pressure of the refrigerant at the second port (152) connected to the first low-stage suction pipe (23*a*) decreases. After the processing of Step ST21 ends, the operation switching section (104) performs the processing of Step ST22.

<Step ST22>

In the processing of Step ST22, the operation switching section (104) decreases the operation frequency of the high-stage compressor (21). As a result, the rotational speed of the high-stage compressor (21) decreases. As can be seen from the description of Step ST11 in FIG. 8, the pressure of the refrigerant flowing through the high-stage discharge pipe (21*b*) decreases as the decrease in the rotational speed of the high-stage compressor (21). Therefore, when the rotational speed of the high-stage compressor (21) decreases, in the four-way switching valves (150) serving as the switching valve (80), the difference between the pressure of the refrigerant at the first port (151) connected to the high-stage discharge pipe (21*b*) and the pressure of the refrigerant at the second port (152) connected to the first low-stage suction pipe (23*a*) decreases.

<Step ST23>

Then, the operation switching section (104) performs the processing of Step ST23. In the processing of Step ST23, the operation switching section (104) gradually opens the control valve (86) in the fully closed state, to a predetermined opening degree.

The processing of Step ST23 is the same as the processing of Step ST13 in FIG. 8. Therefore, as can be seen from the description of Step ST13 in FIG. 8, when the control valve (86) is open, in the four-way switching valve (150) serving as the switching valve (80), the difference between the pressure of the refrigerant at the first port (151) connected to the high-stage discharge pipe (21*b*) and the pressure of the refrigerant at the second port (152) connected to the first low-stage suction pipe (23*a*) decreases.

<Step ST24>

Then, the operation switching section (104) performs the processing of Step ST24. In the processing of Step ST24, the operation switching section (104) outputs an instruction signal for activating the four-way switching valve (150) serving as the switching valve (80) to the switching valve (80). Specifically, the operation switching section (104) outputs, as the instruction signal, a signal for switching energization of the pilot valve (170) of the four-way switching valve (150) to which the instruction signal is output, from one of the ON state or the OFF state to the other. As a result, the four-way switching valve (150) that has received the instruction signal is switched from one of the first state or the second state to the other.

While the first low-stage compressor (23) is stopped and the high-stage compressor (21) is operating, the operation switching section (104) outputs an instruction signal to the four-way switching valves (150) serving as the switching valve (80). Further, the operation switching section (104) reduces the rotational speed of the high-stage compressor (21), further opens the control valve (86), and then outputs the instruction signal to the four-way switching valve (150).

In this way, the operation switching section (104) reduces the difference between the pressure of the refrigerant at the first port (151) and the pressure of the refrigerant at the second port (152), and then outputs the instruction signal to the four-way switching valve (150).

Therefore, the load acting on the valve element (162) and the pistons (163) when the four-way switching valve (150) is switched is reduced, and the impact force caused by the movement of the valve element (162) and the pistons (163) is reduced. As a result, it is possible to prevent the damage to the four-way switching valve (150) and the damage to the pipes connected to the four-way switching valve (150) from occurring, thereby improving reliability of the heat source unit (10).

<Step ST25>

Then, the operation switching section (104) performs the processing of Step ST25. In the processing of Step ST25, the operation switching section (104) fully closes the control valve (86). After the processing of Step ST25 ends, the operation switching section (104) ends the switching operation.

—Features of Second Embodiment—

In the heat source unit (10) of this embodiment, while the low-stage compressor (23) is stopped and the high-stage compressor (21) is operating, the operation switching section (104) of the controller (101) reduces the rotational speed of the high-stage compressor (21), opens the control valve (86), and then outputs the instruction signal to the four-way switching valves (150) serving as the switching valve (80).

In this way, the operation switching section (104) of the controller (101) according to this embodiment reduces the difference between the pressure of the refrigerant at the first port (151) and the pressure of the refrigerant at the second port (152) in the four-way switching valve (150), and then outputs the instruction signal to the four-way switching valve (150). Accordingly, as in the first embodiment, this embodiment makes it possible to prevent the damage to the four-way switching valve (150) and the damage to the pipes connected to the four-way switching valve (150) from occurring, thereby improving reliability of the heat source unit (10).

—Variations of Second Embodiment—

The refrigeration apparatus (1) according to this embodiment may include a cooling unit, such as a refrigeration showcase or a unit cooler, in place of the air-conditioning units (50). In this case, in the refrigeration apparatus (1), the switching valve (80) switches from one of the first state or the second state to the other when switching between the cooling operation of cooling the inside air in the cooling heat exchanger of the cooling unit and the defrosting operation of melting the frost attached to the cooling heat exchanger of the cooling unit.

«Other Embodiments»

—First Variation—

In the refrigeration apparatus (1) according to each of the first and second embodiments, the bypass pipe (85) and the control valve (86) may be omitted. In this case, the operation switching section (104) of the controller (101) performs processing of increasing the opening degree of the expansion valve corresponding to the heat exchanger which functions as an evaporator, in place of the processing of Step ST13 in FIG. 8 or Step ST23 in FIG. 11.

For example, when the outdoor heat exchanger (13) functions as an evaporator before the instruction signal is output to the four-way switching valve (150), the operation switching section (104) increases the opening degree of the outdoor expansion valve (14) corresponding to the outdoor heat exchanger (13) by a predetermined value in the processing in place of Step ST13 or Step ST23.

When the indoor heat exchanger (54) functions as an evaporator before the instruction signal is output to the four-way switching valve (150), the operation switching section (104) increases the opening degree of the indoor expansion valve (53) corresponding to the indoor heat exchanger (54) by a predetermined value in the processing in place of Step ST13 or Step ST23.

When the opening degree of the expansion valve corresponding to the heat exchanger which functions as an evaporator is increased, the pressure of the refrigerant flowing through the first low-stage suction pipe increases. As a result, in the four-way switching valves (150), the difference between the pressure of the refrigerant at the first port (151) connected to the high-stage discharge pipe (21*b*) and the pressure of the refrigerant at the second port (152) connected to the first low-stage suction pipe (23*a*) decreases.

—Second Variation—

The heat source unit according to each of the first and second embodiments may be configured to perform a multi-stage compression refrigeration cycle including three or more stages. In this case, in the heat source unit, the compressor at the lowest stage serves as the low-stage compressor (23), and the compressor at the highest stage serves as the high-stage compressor (21).

While the embodiments and variations thereof have been described above, it will be understood that various changes in form and details may be made without departing from the spirit and scope of the claims. The above-described embodiments and variations may be combined and replaced with each other without deteriorating intended functions of the present disclosure. The ordinal numbers such as "first," "second," "third," . . . in the description and claims are used to distinguish the terms to which these expressions are given, and do not limit the number and order of the terms.

INDUSTRIAL APPLICABILITY

As can be seen from the foregoing, the present disclosure is useful for a heat source unit and a refrigeration apparatus.

EXPLANATION OF REFERENCES

1 Refrigeration Apparatus
10 Heat Source Unit
21 High-Stage Compressor
21*b* High-Stage Discharge Pipe (Discharge Pipe)
22 Second Low-Stage Compressor
23 First Low-Stage Compressor (Low-Stage Compressor)
23*a* First Low-Stage Suction Pipe (Suction Pipe)
24*c* First Low-Stage Pipe (Low-Stage Pipe)
50 Air-Conditioning Unit (First Utilization-Side Unit, Utilization Unit)
60 Cooling Unit (Second Utilization-Side Unit)
85 Bypass Pipe
86 Control Valve
101 Controller
150 Four-Way Switching Valve

The invention claimed is:

1. A heat source unit connected to a utilization-side unit and configured to perform a refrigeration cycle, the heat source unit comprising:
a heat-source-side heat exchanger;
a low-stage compressor;
a high-stage compressor configured to suck and compress a refrigerant discharged from the low-stage compressor;
a four-way switching valve;
a low-stage pipe which is provided in parallel with the low-stage compressor and through which the refrigerant flows while the low-stage compressor is stopped; and
a controller, wherein
the controller is configured to activate the four-way switching valve between a first state and a second state, wherein
in the first state, the refrigerant having evaporated in the utilization-side unit is sucked into the low-stage compressor and refrigerant discharged from the high-stage compressor is supplied to the heat-source side heat exchanger, and
in the second state, the refrigerant having evaporated in the heat source-side heat exchanger is sucked into the low-stage compressor and the refrigerant discharged from the high-stage compressor is supplied to the utilization-side unit, and wherein
the controller is further configured to:
output an instruction signal for activating the four-way switching valve to switch an operation performed by the heat source unit while the low-stage compressor is stopped and the high-stage compressor is operating, and
output the instruction signal to the four-way switching valve after stopping the low-stage compressor, if the low-stage compressor is operating at a time of switching the operation performed by the heat source unit.

2. The heat source unit of claim 1, wherein
the four-way switching valve includes a valve element configured to be actuated by a pressure of the refrigerant.

3. The heat source unit of claim 2, wherein
the controller outputs the instruction signal to the four-way switching valve after decreasing the rotational speed of the high-stage compressor.

4. The heat source unit of claim 3, further comprising:
a suction pipe through which the refrigerant sucked into the low-stage compressor flows;
a discharge pipe through which the refrigerant discharged from the high-stage compressor flows;
a bypass pipe connecting the suction pipe and the discharge pipe; and
a control valve provided in the bypass pipe and having a variable opening degree, wherein
the controller outputs the instruction signal to the four-way switching valve after opening the control valve.

5. The heat source unit of claim 4, wherein
the utilization-side unit to which the heat source unit is connected includes: a first utilization-side unit and a second utilization-side unit,
the low-stage compressor includes: a first low-stage compressor configured to suck the refrigerant from the first utilization-side unit; and a second low-stage compressor configured to suck the refrigerant from the second utilization-side unit,
the four-way switching valve switches a flow path of the refrigerant sucked into the first low-stage compressor and a flow path of the refrigerant discharged from the high-stage compressor, and
the controller outputs the instruction signal to the four-way switching valve while the first low-stage compressor is stopped and the high-stage compressor is operating.

6. The heat source unit of claim 4, wherein
the controller opens the control valve and then outputs the instruction signal to the four-way switching valve.

7. The heat source unit of claim 2, further comprising:
a suction pipe through which the refrigerant sucked into the low-stage compressor lows;
a discharge pipe through which the refrigerant discharged from the high-stage compressor flows;
a bypass pipe connecting the suction pipe and the discharge pipe; and
a control valve provided in the bypass pipe and having a variable opening degree, wherein
the controller outputs the instruction signal to the four-way switching valve after opening the control valve.

8. The heat source unit of claim 1, wherein
the controller outputs the instruction signal to the four-way switching valve after decreasing the rotational speed of the high-stage compressor.

9. The heat source unit of claim 8, further comprising:
a suction pipe through which the refrigerant sucked into the low-stage compressor lows;
a discharge pipe through which the refrigerant discharged from the high-stage compressor flows;
a bypass pipe connecting the suction pipe and the discharge pipe; and
a control valve provided in the bypass pipe and having a variable opening degree, wherein
the controller outputs the instruction signal to the four-way switching valve after opening the control valve.

10. The heat source unit of claim 1, further comprising:
a suction pipe through which the refrigerant sucked into the low-stage compressor flows;

a discharge pipe through which the refrigerant discharged from the high-stage compressor flows;

a bypass pipe connecting the suction pipe and the discharge pipe; and a control valve provided in the bypass pipe and having a variable opening degree, wherein the controller outputs the instruction signal to the four-way switching valve after opening the control valve.

11. The heat source unit of claim 10, wherein the controller opens the control valve and then outputs the instruction signal to the four-way switching valve.

12. The heat source unit of claim 10, wherein the controller closes the control valve after the output of the instruction signal to the four-way switching valve.

13. The heat source unit of claim 1, wherein the utilization-side unit to which the heat source unit is connected includes: a first utilization-side unit and a second utilization-side unit, the low-stage compressor includes: a first low-stage compressor configured to suck the refrigerant from the first utilization-side unit; and a second low-stage compressor configured to suck the refrigerant from the second utilization-side unit, the four-way switching valve switches a flow path of the refrigerant sucked into the first low-stage compressor and a flow path of the refrigerant discharged from the high-stage compressor, and the controller outputs the instruction signal to the four-way switching valve while the first low-stage compressor is stopped and the high-stage compressor is operating.

14. The heat source unit of claim 13, further comprising:

a suction pipe through which the refrigerant sucked into the first low-stage compressor flows;

a discharge pipe through which the refrigerant discharged from the high-stage compressor flows;

a bypass pipe connecting the suction pipe and the discharge pipe; and a control valve provided in the bypass pipe and having a variable opening degree, wherein the controller outputs the instruction signal to the four-way switching valve after opening the control valve.

15. The heat source unit of claim 14, wherein the controller opens the control valve and then outputs the instruction signal to the four-way switching valve.

16. The heat source unit of claim 14, wherein the controller closes the control valve after the output of the instruction signal to the four-way switching valve.

17. A refrigeration apparatus comprising:

the heat source unit of claim 1, and a utilization-side unit connected to the heat source unit.

18. A heat source unit connected to a utilization-side unit and configured to perform a refrigeration cycle, the heat source unit comprising:

a heat-source-side heat exchanger;

a low-stage compressor;

a high-stage compressor configured to suck and compress a refrigerant discharged from the low-stage compressor;

a flow path switching mechanism, a low-stage pipe which is provided in parallel with the low-stage compressor and through which the refrigerant flows while the low-stage compressor is stopped; and a controller, wherein the flow path switching mechanism includes a first switching valve and a second switching valve, each of the first switching valve and the second switching valve is a four-way switching valve, the controller is configured to activate the flow path switching mechanism between a first state and a second state, wherein in the first state, the refrigerant having evaporated in the utilization-side unit is sucked into the low-stage compressor and the refrigerant discharged from the high-stage compressor is supplied to the heat-source side heat exchanger, and in the second state, the refrigerant having evaporated in the heat source-side heat exchanger is sucked into the low-stage compressor and the refrigerant discharged from the high-stage compressor is supplied to the utilization-side unit, wherein the controller is further configured to output an instruction signal for activating the four-way switching valve serving as one of the first switching valve or the second switching valve which needs to be switched, to switch an operation performed by the heat source unit while the low-stage compressor is stopped and the high-stage compressor is operating, and output the instruction signal to the four-way switching valve serving as the one of the first switching valve or the second switching valve which needs to be switched, after stopping the low-stage compressor, if the low-stage compressor is operating at a time of switching the operation performed by the heat source unit.

19. A heat source unit connected to a utilization-side unit and configured to perform a refrigeration cycle, the heat source unit comprising:

a heat-source-side heat exchanger;

a low-stage compressor;

a high-stage compressor configured to suck and compress a refrigerant discharged from the low-stage compressor;

a first switching valve;

a second switching valve;

a low-stage pipe which is provided in parallel with the low-stage compressor and through which the refrigerant flows while the low-stage compressor is stopped; and a controller, wherein each of the first switching valve and the second switching valve is a four-way switching valve, the controller is configured to switch the four-way switching valve serving as the first switching valve between: a state in which the refrigerant having evaporated in the utilization-side unit is sucked into the low-stage compressor; and a state in which the refrigerant discharged from the high-stage compressor is supplied to the utilization-side unit, and switch the four-way switching valve serving as the second switching valve between a state in which the refrigerant discharged from the high-stage compressor is supplied to the heat-source side heat exchanger, and a state in which the refrigerant having evaporated in the heat source-side heat exchanger is sucked into the low-stage compressor, wherein the controller is further configured to output an instruction signal for activating the four-way switching valve serving as one of the first switching valve or the second switching valve which needs to be switched, to switch an operation performed by the heat source unit while the low-stage compressor is stopped and the high-stage compressor is operating, and output the instruction signal to the four-way switching valve serving as the one of the first switching valve or the second switching valve which needs to be switched, after stopping the low-stage compressor, if the low-stage compressor is operating at a time of switching the operation performed by the heat source unit.

* * * * *